US008955436B2

(12) United States Patent
Hirano et al.

(10) Patent No.: US 8,955,436 B2
(45) **Date of Patent: *Feb. 17, 2015**

(54) INK FILM THICKNESS DISTRIBUTION FORMING METHOD AND APPARATUS

(75) Inventors: Masahiro Hirano, Ibaraki (JP); Hiromichi Totsuka, Ibaraki (JP)

(73) Assignee: Komori Corporation, Tokyo (JP)

( * ) Notice: Subject to any disclaimer, the term of this patent is extended or adjusted under 35 U.S.C. 154(b) by 52 days.

This patent is subject to a terminal disclaimer.

(21) Appl. No.: 13/600,170

(22) Filed: Aug. 30, 2012

(65) Prior Publication Data

US 2013/0061769 A1 Mar. 14, 2013

(30) Foreign Application Priority Data

Sep. 12, 2011 (JP) ..... 2011-198387

(51) Int. Cl.

| | |
|---|---|
| ***B41F 31/30*** | (2006.01) |
| ***B41F 31/20*** | (2006.01) |
| ***B41F 35/04*** | (2006.01) |
| ***B41F 33/10*** | (2006.01) |
| ***B41F 31/04*** | (2006.01) |
| ***B41F 31/36*** | (2006.01) |

(52) U.S. Cl.

CPC ..... *B41F 31/045* (2013.01); *B41F 31/20* (2013.01); *B41F 31/36* (2013.01); *B41F 33/10* (2013.01); *B41F 35/04* (2013.01); *B41P 2235/26* (2013.01)

USPC ..... 101/351.3; 101/425; 101/484

(58) Field of Classification Search

CPC ..... B41F 31/301; B41F 31/302; B41F 31/10; B41F 31/12; B41F 31/045; B41F 35/04; B41P 2233/11; B41P 2233/51

USPC ..... 101/351.3, 351.1, 351.2, 351.4, 352.04, 101/352.01, 352.02, 352.03, 352.05, 484, 101/365, DIG. 45, DIG. 47

See application file for complete search history.

(56) References Cited

U.S. PATENT DOCUMENTS 3,701,316 A * 10/1972 Sylvester et al. ..... 101/148
4,882,991 A * 11/1989 Simeth ..... 101/350.2

(Continued)

FOREIGN PATENT DOCUMENTS

| | | |
|---|---|---|
| CN | 92105125.5 | 8/1993 |
| CN | 101172414 A | 5/2008 |
| CN | 101254690 A | 9/2008 |
| EP | 0 816 074 A1 | 1/1998 |

(Continued)

*Primary Examiner* — Jill Culler
*Assistant Examiner* — Leo T Hinze
(74) *Attorney, Agent, or Firm* — Blakely Sokoloff Taylor & Zafman

(57) ABSTRACT

An ink film thickness distribution forming method in an ink supply apparatus including an ink fountain. A plurality of ink fountain keys are arranged in the ink fountain. Ink is supplied to an ink fountain roller in accordance with the opening ratios of the plurality of ink fountain keys. Ink is transferred to an ink ductor roller from the ink fountain roller. Ink from the ink doctor roller is transferred to an ink roller group including at least one ink form roller. A throw-off operation of the ink form roller positioned at an end of the ink roller group is performed after the end of a print job. The ink roller group is divided into a plurality of roller subgroups after the end of the print job. The ink in at least one of roller subgroups is removed. An ink film thickness distribution forming apparatus is also disclosed.

4 Claims, 20 Drawing Sheets

(56) References Cited

U.S. PATENT DOCUMENTS

| | | | | |
|---|---|---|---|---|
| 5,365,849 | A * | 11/1994 | Spiegel | 101/423 |
| 6,116,161 | A * | 9/2000 | Voge et al. | 101/483 |
| 6,453,812 | B1 | 9/2002 | Ikeda et al. | |
| 6,615,728 | B2 * | 9/2003 | Kurata et al. | 101/484 |
| 6,712,002 | B2 * | 3/2004 | Herbst et al. | 101/351.1 |
| 8,201,903 | B2 * | 6/2012 | Hirano | 347/7 |
| 2007/0022888 | A1 * | 2/2007 | Inde et al. | 101/365 |

FOREIGN PATENT DOCUMENTS

| | | | |
|---|---|---|---|
| JP | S58-201008 | A | 11/1983 |
| JP | S58-201010 | A | 11/1983 |
| JP | 07-096600 | | 4/1995 |
| JP | H10-016193 | A | 1/1998 |
| JP | 11-188844 | | 7/1999 |
| JP | H11-188844 | A | 7/1999 |

* cited by examiner

INK FILM THICKNESS DISTRIBUTION FORMING METHOD AND APPARATUS

BACKGROUND OF THE INVENTION

The present invention relates to an ink film thickness distribution forming method and apparatus for forming an ink film thickness distribution in an ink roller group in an ink supply apparatus.

FIG. 11 shows the main part of an inker (ink supply apparatus) in a printing unit of each color in a web offset printing press. In FIG. 11, the inker includes an ink fountain 1, an ink 2 stored in the ink fountain 1, an ink fountain roller 3, a plurality of ink fountain keys 4 (4-1 to **4-*n*) juxtaposed in the axial direction of the ink fountain roller 3, an ink ductor roller 5, an ink roller group 6, a printing plate 7, and a plate cylinder 8 on which the printing plate 7 is mounted. An image is printed on the printing plate 7**.

In the ink supply apparatus, the ink 2 in the ink fountain 1 is supplied to the ink fountain roller 3 by adjusting the opening degrees of the ink fountain keys 4-1 to **4-*n*. The ink supplied to the ink fountain roller 3 is supplied to the printing plate 7 via the ink roller group 6 by the ink feed operation of the ink ductor roller 5. Note that ink form rollers 6-1 to 6-4 in contact with the printing plate 7 are arranged at the end of the ink flow path of the ink roller group 6**.

When switching a print job in the ink supply apparatus, that is, when replacing the printing plate 7 for a preceding print job with a printing plate 7' for the next print job, the opening degrees of the ink fountain keys 4-1 to **4-*n*, the rotation amount of the ink fountain roller 3, and the like are changed to values corresponding to an image on the printing plate 7' for the next print job. The ink 2 in the ink fountain 1 is supplied to the replaced printing plate 7' via the ink roller group 6. In this case, test printing is performed before final printing to adjust the ink supply amount, obtaining a satisfactory color tone. As a result, a desired ink film thickness distribution (gradient of the ink film thickness) is formed in the ink roller group 6**.

However, in a conventional ink supply apparatus, when the printing plate 7 is replaced with the printing plate 7' to execute the next print job, an ink film thickness distribution corresponding to the printing plate 7 for the preceding print job remains in the ink roller group 6. In this case, the ink film thickness distribution corresponding to the printing plate 7 for the preceding print job needs to be gradually changed to an ink film thickness distribution corresponding o the printing plate 7' for the next print job. Adjustment of the ink supply amount and test printing are required excessively until a satisfactory color tone is obtained. This causes problems such as "increase in pre-printing preparation time", "increase in work load", "waste of printing materials", "decrease in production efficiency", and "increase in cost".

To reduce adjustment of the ink supply amount and the test printing count until a satisfactory color tone is obtained, there have been proposed ink film thickness control methods disclosed in Japanese Patent Laid-Open Nos. 10-16193 (literature 1) and Japanese Patent Laid-Open No. 11-188844 (literature 2).

[Literature 1 (Ink-decrease+Pre-inking 2)]

In the ink film thickness control method described in literature 1, when switching a print job, the ink feed operation of the ink ductor roller 5 is stopped. While the printing plate 7 for the preceding print job is kept mounted, the printing press is operated to print a predetermined number of sheets (blank sheet printing), decreasing ink in the ink supply apparatus (ink-decrease). A minimum ink film thickness distribution Ma (see FIG. 12A) which thins from the upstream side to downstream side of the ink roller group 6 and is required during printing, that is, an ink film thickness distribution Ma corresponding to an image-free portion of the printing plate 7 remains (ink removing).

Then, the opening degrees of the ink fountain keys 4-1 to **4-*n*, the rotation amount of the ink fountain roller 3, and the like are set to values corresponding to an image on the printing plate 7' for the next print job. The printing press is operated to perform the ink feed operation of the ink ductor roller 5 by a predetermined number of times. An ink film thickness distribution Mb (see FIG. 12B) corresponding to the image on the printing plate 7' for the next print job is superposed on the minimum ink film thickness distribution Ma which remains in the ink roller group 6** and is required during printing (pre-inking 2).

[Literature 2 (Ink Return to Fountain+Pre-inking 1)]

In the ink film thickness control method described in literature 2, when switching a print job, the opening ratios of the ink fountain keys 4-1 to **4-*n* are set to 0. In this state, the ink feed operation of the ink ductor roller 5 is performed by a predetermined number of times, returning all ink remaining in the ink roller group 6 to the ink fountain 1 ("ink return to fountain"). As a result, each roller in the ink roller group 6** does not hold any ink.

The opening degrees of the ink fountain keys 4-1 to **4-*n* are set to a predetermined value (e.g., 50%), and the rotation amount of the ink fountain roller 3 is set to a predetermined value (e.g., 50%). Then, the ink feed operation of the ink ductor roller 5 is performed by a predetermined number of times, forming a minimum ink film thickness distribution Ma (see FIG. 12A) required during printing in the ink roller group 6** (first step of pre-inking 1).

The opening degrees of the ink fountain keys 4-1 to **4-*n*, the rotation amount of the ink fountain roller 3, and the like are set to values corresponding to the image on the printing plate 7' for the next print job. The printing press is operated to perform the ink feed operation of the ink ductor roller 5 by a predetermined number of times. An ink film thickness distribution Mb (see FIG. 12B) corresponding to the image on the printing plate 7' for the next print job is superposed on the minimum ink film thickness distribution Ma which is formed in the ink roller group 6** and required during printing (second step of pre-inking 1).

However, the ink film thickness control method described in literature 1 (ink-decrease+pre-inking 2) wastes sheets because blank sheet printing is executed when leaving the ink film thickness distribution Ma on the ink roller group 6.

The ink film thickness control method described in literature 2 ("ink return to fountain"+pre-inking 1) takes time because all ink on the ink roller group 6 is returned to the ink fountain 1 and an ink film thickness distribution (Ma+Mb) corresponding to the image on the printing plate 7' for the next print job is formed from 0. In this method, emulsified ink (ink kneaded with damping water) is returned to the ink fountain 1. A printing trouble may occur, wasting printing materials.

SUMMARY OF THE INVENTION

The present invention has been made to solve the above problems, and has as its object to provide an ink film thickness distribution forming method and apparatus capable of forming, in an ink roller group within a short time, an ink film thickness distribution corresponding to an image on a printing plate to be used for printing of the next job, without performing blank sheet printing or "ink return to fountain" when switching a print job.

In order to achieve the above-described object, according to the present invention, there is provided an ink film thickness distribution forming method in an ink supply apparatus including an ink fountain storing an ink, a plurality of ink fountain keys arranged in the ink fountain, an ink fountain roller to which the ink is supplied from the ink fountain in accordance with opening ratios of the plurality of ink fountain keys, an ink ductor roller to which the ink is transferred from the ink fountain roller by an ink feed operation, and an ink roller group including at least one ink form roller to which the ink transferred to the ink ductor roller is supplied, comprising the steps of performing a throw-off operation of the ink form roller positioned at an end of the ink roller group after an end of a print job using a preceding printing plate, stopping the ink feed operation of the ink ductor roller after the end of the print job using the preceding printing plate, dividing the ink roller group into a plurality of roller subgroups after the end of the print job using the preceding printing plate, and removing the ink in at least one of roller subgroups out of the plurality of divided roller subgroups.

According to the present invention, after the end of a print job using a preceding printing plate, ink form rollers positioned at the end of the ink flow path of an ink roller group are thrown off, and the ink feed operation of the ink ductor roller is stopped. Then, the ink roller group is divided into a plurality of roller subgroups, and ink in at least one of the divided roller subgroups is removed. The ink in at least one of the roller subgroups is removed by, for example, using an ink cleaning device or scraping the ink by a blade. Hence, an ink film thickness distribution corresponding to an image on a printing plate to be used for printing of the next job can be formed in the ink roller group within a short time without performing blank sheet printing or "ink return to fountain" when switching a print job.

DESCRIPTION OF THE PREFERRED EMBODIMENT

Figure 1:
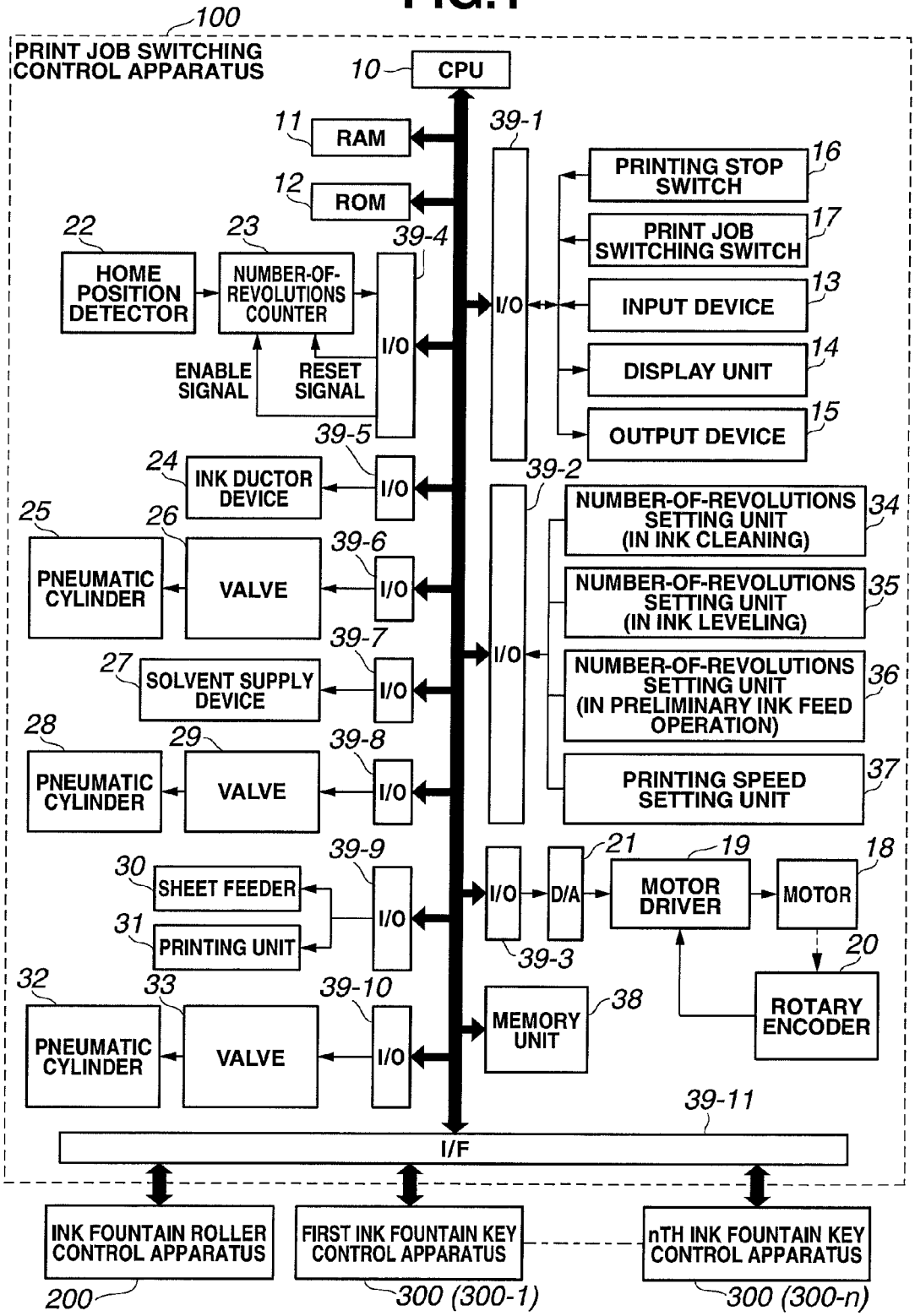
FIG. 1 is a block diagram showing a print job switching control apparatus according to an embodiment of the present invention.

The present invention will be described in detail below with reference to the accompanying drawings.

A print job switching control apparatus 100 according to the embodiment includes a CPU 10, a RAM 11, a ROM 12, an input device 13, a display unit 14, an output device (e.g., printer) 15, a printing stop switch 16, a print job switching switch 17, a printing press drive motor 18, a drive motor driver 19, a drive motor rotary encoder 20, a D/A converter 21, a printing press home position detector 22, a counter 23 for counting the number of revolutions of a printing press, and an ink ductor device 24.

The print job switching control apparatus 100 includes a roller group division/coupling pneumatic cylinder 25, a roller group division/coupling pneumatic cylinder valve 26, a solvent supply device 27, a doctor throw-on/off pneumatic cylinder 28, a doctor throw-on/off pneumatic cylinder valve 29, a sheet feeder 30, a printing unit 31, an ink form roller throw-on/off pneumatic cylinder 32, an ink form roller throw-on/off pneumatic cylinder valve 33, a number-of-revolutions setting unit 34 in ink cleaning, a number-of-revolutions setting unit 35 in ink leveling, a number-of-revolutions setting unit 36 in a preliminary ink feed operation, a printing speed setting unit 37, a memory unit 38, and input/output interfaces (I/O I/Fs) 39-1 to 39-11.

Figure 2:
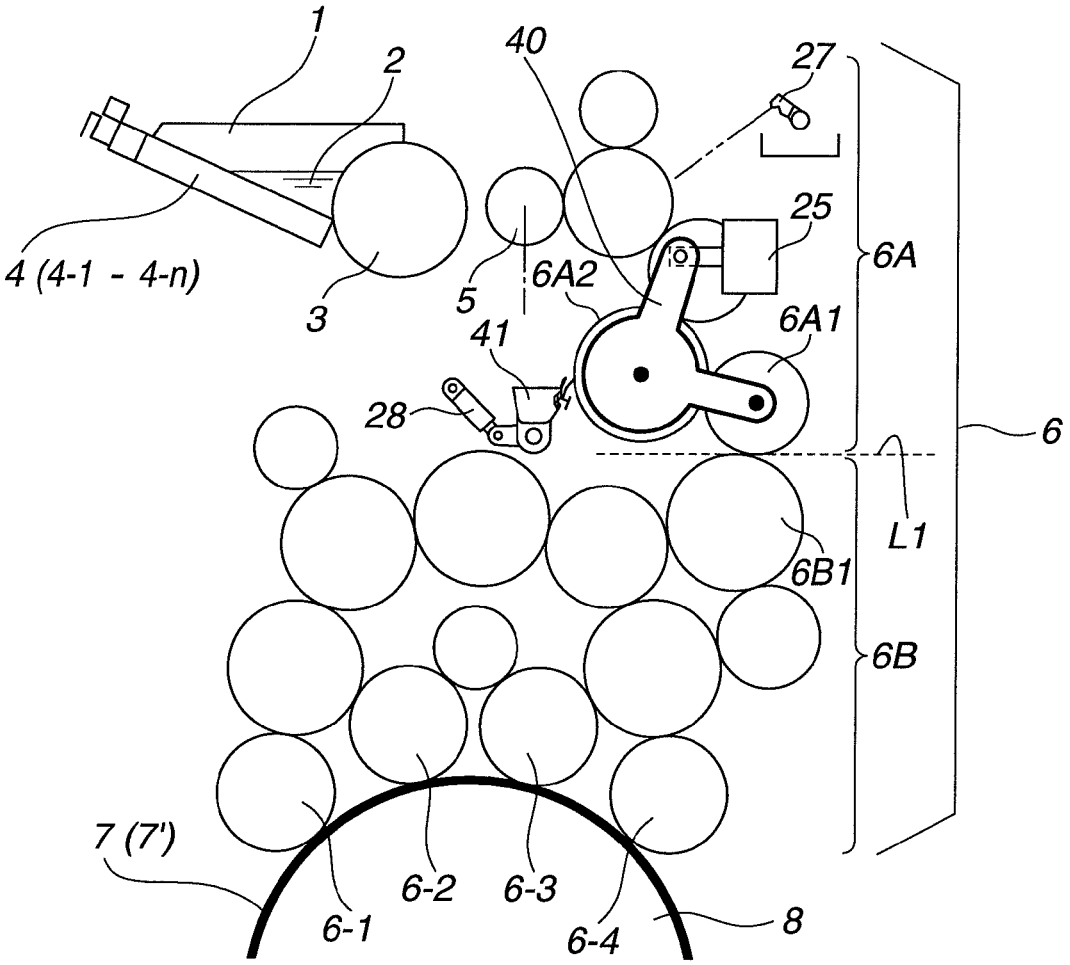
FIG. 2 is a view showing the main part (coupling state before dividing an ink roller group) of an ink supply apparatus to be controlled by the print job switching control apparatus shown in FIG. 1.
Figure 11:
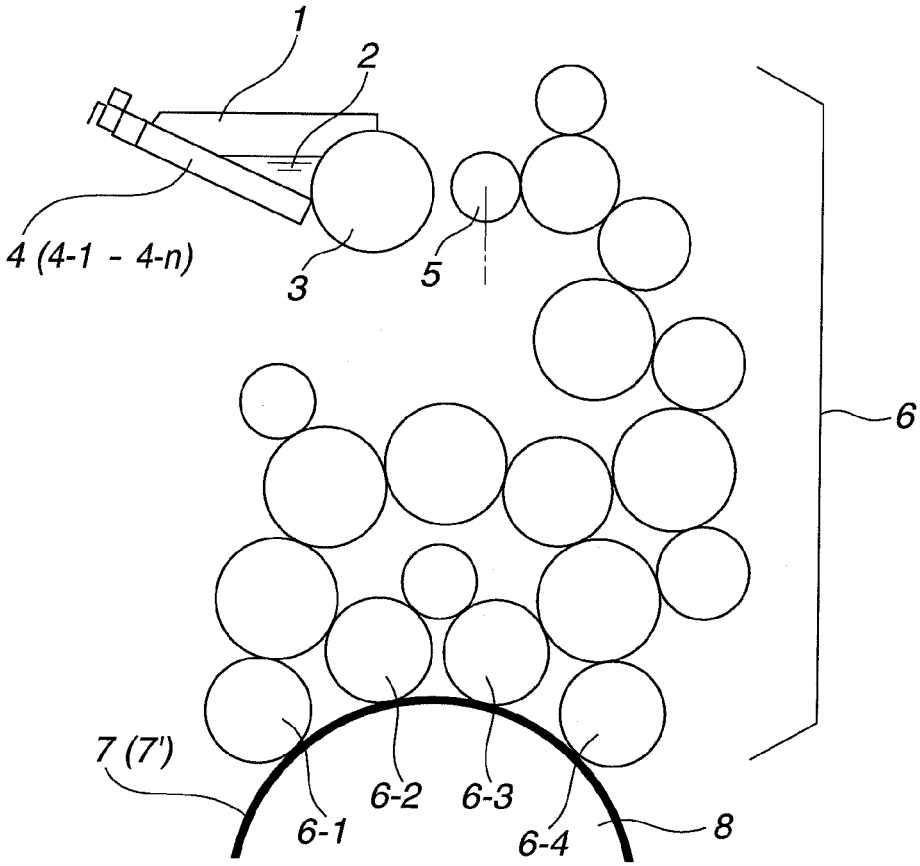
FIG. 11 is a view showing the main part of an ink supply apparatus in a printing unit of each color in a printing press.
Figure 12A:
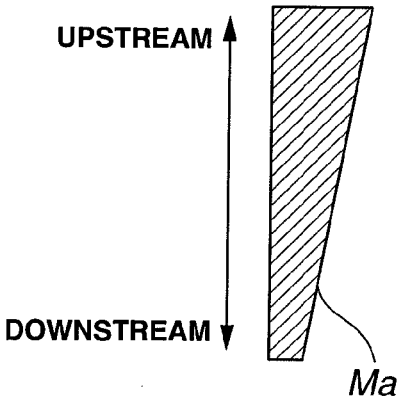
FIGS. 12A and 12B are views showing ink film thickness distributions Ma and Mb formed on the ink roller group of the ink supply apparatus.
Figure 12B:
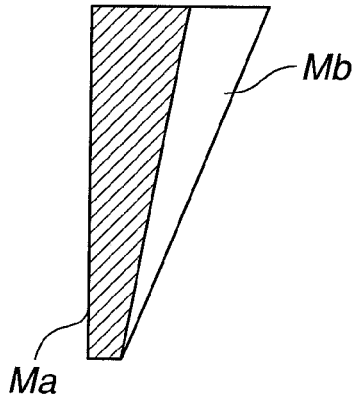

In FIG. 2, the same reference numerals as those in FIG. 11 denote the same or similar parts as those shown in FIG. 11, and a description thereof will not be repeated. In an ink supply apparatus shown in FIG. 2, an ink roller group 6 which forms an ink supply path can be divided into an upstream roller subgroup 6A and downstream roller subgroup 6B at the boundary of a dotted line L1.

More specifically, a roller 6A1 positioned at the lowermost end of the ink flow path of the upstream roller subgroup 6A is axially supported by one end of a swing arm 40 which swings about, as the pivot center, the axis of a roller 6A2 which contacts the outer surface of the roller 6A1. The pneumatic cylinder 25 is coupled to the other end of the swing arm 40.

In this structure, when the pneumatic cylinder 25 extends (see FIG. 3), the swing arm 40 swings in a direction indicated by an arrow A about the axis of the roller 6A2 serving as the pivot center. As the swing arm 40 swings, the roller 6A1 moves apart from a roller 6B1 positioned at the uppermost end of the ink flow path of the downstream roller subgroup 6B while rolling on the roller 6A2. As a result, the ink roller group 6 is divided into the upstream roller subgroup 6A and downstream roller subgroup 6B.

When the pneumatic cylinder 25 contracts from this state, the swing arm 40 swings in a direction indicated by an arrow B about the axis of the roller 6A2 serving as the pivot center. As the swing arm 40 swings, the roller 6A1 comes into contact with the outer surface of the roller 6B1 at the uppermost end of the downstream roller subgroup 6B while rolling on the roller 6A2 (see FIG. 2). Accordingly, the upstream roller subgroup 6A and downstream roller subgroup 6B are coupled and return to the single ink roller group 6.

The ink roller group 6 includes the solvent supply device 27 which injects a solvent from the upstream side of the upstream roller subgroup 6A, and a doctor 41 which comes into contact with the outer surface of the roller 6A2 of the upstream roller subgroup 6A to recover the solvent. The doctor 41 includes the doctor throw-on/off pneumatic cylinder 28. When recovering the solvent, the pneumatic cylinder 28 extends to bring the doctor 41 into contact with the outer surface of the roller 6A2. When the pneumatic cylinder 28 contracts, the doctor 41 moves apart from the outer surface of the roller 6A2.

In FIG. 1, the CPU 10 obtains various kinds of information input via the interfaces 39-1 to 39-11. While accessing the RAM 11 and memory unit 38, the CPU 10 operates in accordance with a program stored in the ROM 12.

The rotary encoder 20 generates a rotation pulse at every predetermined rotation angle of the motor 18, and outputs it to the motor driver 19. The printing press home position detector 22 detects a home position in every rotation of the printing press, generates a home position detection signal, and outputs it to the counter 23 for counting the number of revolutions of the printing press.

The ink ductor device 24 is arranged for the ink ductor roller 5. When the ink ductor device 24 is turned on, the ink feed operation of the ink ductor roller 5 starts. When the ink ductor device 24 is turned off, the ink feed operation of the ink ductor roller 5 stops. The pneumatic cylinder 32 is arranged for ink form rollers 6-1 to 6-4. When the pneumatic cylinder 32 extends, the ink form rollers 6-1 to 6-4 are thrown on (come into contact with a printing plate 7). When the pneumatic cylinder 32 contracts, the ink form rollers 6-1 to 6-4 are thrown off (move apart from the printing plate 7).

Figure 4:
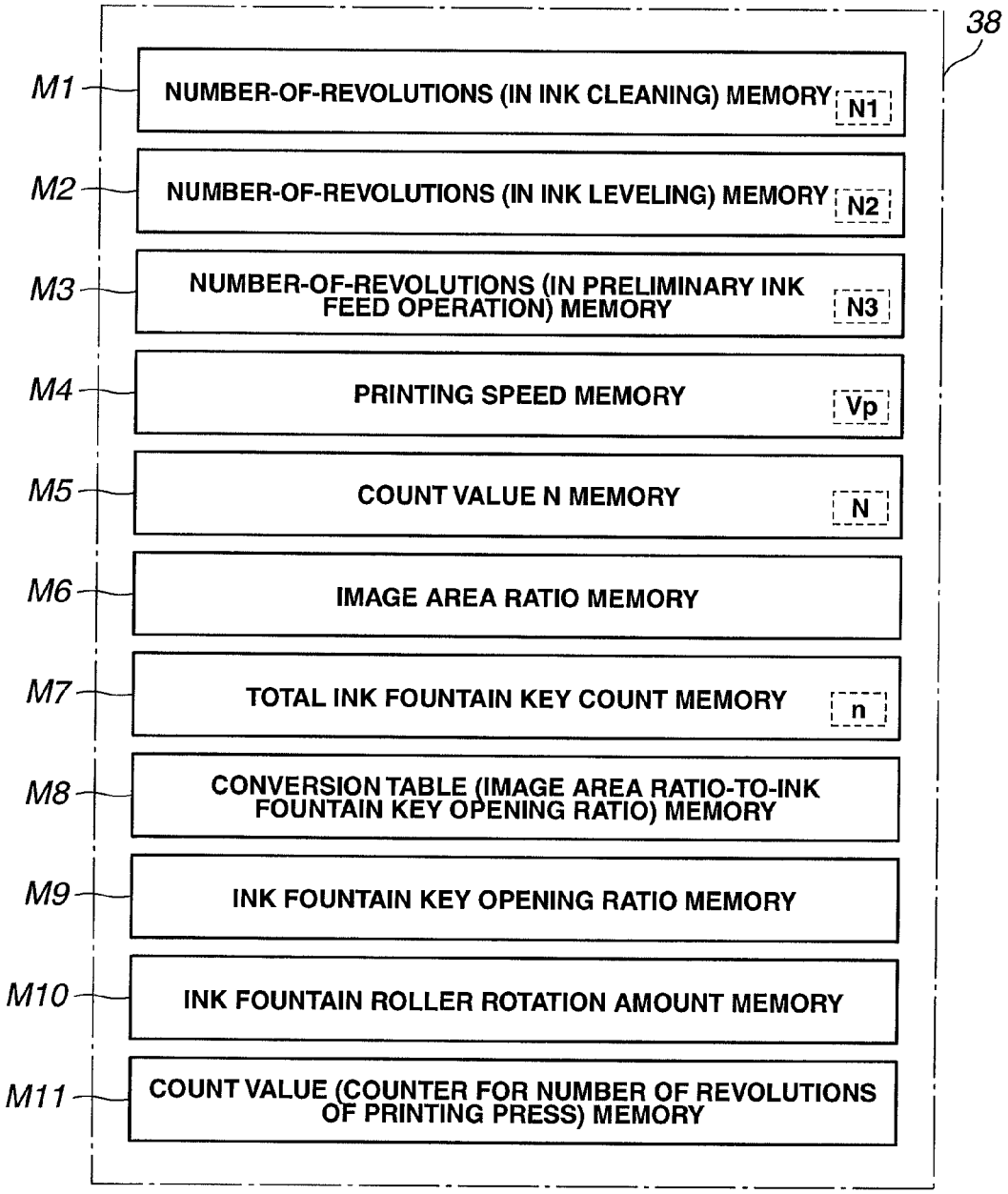
FIG. 4 is a view showing details of a memory unit shown in FIG. 1.

FIG. 4 shows details of the memory unit 38. The memory unit 38 includes memories M1 to M11. The number-of-revolutions memory M1 stores the number N1 of revolutions of the printing press in ink cleaning. The number-of-revolutions memory M2 stores the number N2 of revolutions of the printing press in ink leveling. The number-of-revolutions memory M3 stores the number N3 of revolutions of the printing press in the preliminary ink feed operation. The printing speed memory M4 stores a printing speed Vp. The count value N memory M5 stores a count value N. The image area ratio memory M6 stores the image area ratio of a range corresponding to each ink fountain key.

The total ink fountain key count memory M7 stores a total ink fountain key count n. The conversion table memory M8 stores an image area ratio-to-ink fountain key opening ratio conversion table representing the relationship between the image area ratio and the opening ratio of the ink fountain key. The ink fountain key opening ratio memory M9 stores the opening ratio of each ink fountain key. The ink fountain roller rotation amount memory M10 stores the rotation amount of the ink fountain roller. The count value memory M11 stores the count value of the counter for counting the number of revolutions of the printing press.

In FIG. 1, an ink fountain roller control apparatus 200 drives the ink fountain roller 3 in the ink supply apparatus. Ink fountain key control apparatuses 300-1 to **300-*n* control the opening ratios of the ink fountain keys 4-1 to 4-*n* in the ink supply apparatus. The ink fountain roller control apparatus 200 and ink fountain key control apparatuses 300-1 to 300-*n*** are arranged for ink supply apparatuses of respective colors. However, the embodiment will explain one ink supply apparatus for descriptive convenience. That is, the operation of one of the ink supply apparatuses will be explained as a representative.

[Schematic Operation of Print Job Switching Control Apparatus]

Before a description of the detailed operation of the print job switching control apparatus 100, a schematic operation will be explained as steps (1) to (9) below to facilitate understanding.

Figures 5A, 5B, 5C, 5D, 5E:
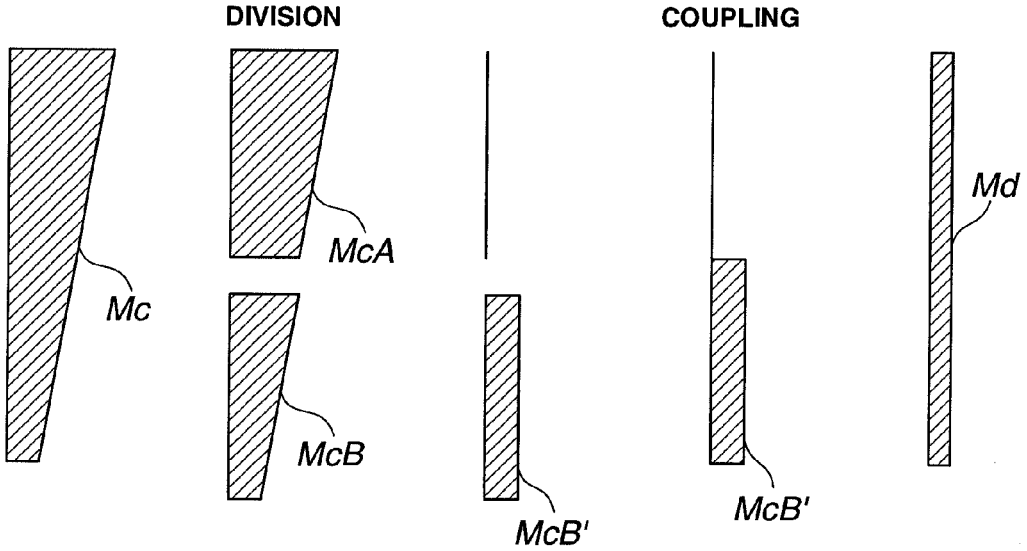
FIGS. 5A to 5I are views showing formation processes for the ink film thickness distribution of the next print job in the ink roller group when switching a print job.

(1) Sheet feed stops. In addition, the ink form rollers 6-1 to 6-4 are thrown off, and printing using the printing plate 7 is stopped (preceding print job is ended). In this case, an ink film thickness distribution Mc corresponding to an image on the printing plate 7 remains in the ink roller group 6, as shown in FIG. 5A. That is, the ink film thickness distribution Mc of the preceding print job remains.

(2) The opening ratios of the ink fountain keys 4-1 to **4-*n* are set to values corresponding to an image on a printing plate 7' to be used for printing of the next job. That is, the opening ratios of the ink fountain keys 4-1 to 4-*n*** are set to values corresponding to the image of the next print job.

(3) The ink feed operation of the ink ductor roller 5 is stopped while the printing press stops. The ink roller group 6 is divided into the upstream roller subgroup 6A and downstream roller subgroup 6B. As shown in FIG. 5B, the ink film thickness distribution Mc of the ink roller group 6 is divided into an ink film thickness distribution McA of the upstream roller subgroup 6A and an ink film thickness distribution McB of the downstream roller subgroup 6B.

(4) The rotational speed of the printing press is increased to 8,000 rph, and an ink cleaning device formed from the solvent supply device 27 and doctor 41 is turned on. In this state, the printing press rotates by a predetermined number of revolutions (number N1 of revolutions in ink cleaning), cleaning ink in the upstream roller subgroup 6A. Hence, the ink film thickness distribution McA of the upstream roller subgroup 6A becomes almost 0, as shown in FIG. 5C. At this time, the ink film thickness distribution of the downstream roller subgroup 6B is leveled by the number N1 of revolutions in ink cleaning, obtaining a flat ink film thickness distribution McB'.

(5) The upstream roller subgroup 6A and downstream roller subgroup 6B are coupled and return to the single ink roller group 6 (FIG. 5D). Thereafter, the printing press rotates by a predetermined number of revolutions (number N2 of revolutions in ink leveling). The ink film thickness distribution McB' remaining in the downstream roller subgroup 6B is leveled between the downstream roller subgroup 6B and the upstream roller subgroup 6A, forming a thin, flat ink film thickness distribution (basic ink film thickness distribution) Md (FIG. 5E) in the ink roller group 6.

Figures 5F, 5G, 5H, 5I:
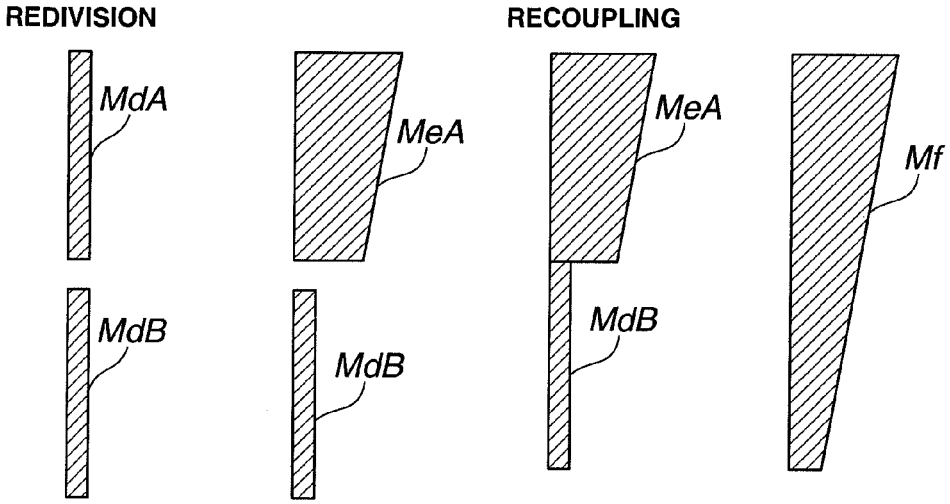

(6) The ink roller group 6 is divided again into the upstream roller subgroup 6A and downstream roller subgroup 6B. As shown in FIG. 5F, the ink film thickness distribution Md of the ink roller group 6 is divided into a basic ink film thickness distribution MdA of the upstream roller subgroup 6A and a basic ink film thickness distribution MdB of the downstream roller subgroup 6B.

(7) It is confirmed that setting of the opening ratios of the ink fountain keys 4-1 to **4-*n* has been completed. After the confirmation, the ink feed operation of the ink ductor roller 5 starts. The printing press rotates by a predetermined number of revolutions (number N3 of revolutions in the preliminary ink feed operation), forming an ink film thickness distribution MeA in preliminary ink feed in the upstream roller subgroup 6A (FIG. 5**G).

(8) The upstream roller subgroup 6A and downstream roller subgroup 6B are coupled again and return to the single ink roller group 6 (FIG. 5H).

(9) The ink form rollers 6-1 to 6-4 are thrown on, sheet feed starts, and a print job using the next printing plate 7' starts (at this time, replacement of the preceding printing plate 7 with the next printing plate 7' has already been completed).

In this case, an ink film thickness distribution (ink film thickness distribution in final printing) in printing using the next printing plate 7' is formed during printing, that is, while consuming ink from the end of the ink roller group 6. At this time, the ink film thickness distribution MdB in the downstream roller subgroup 6B becomes thinner than that during normal printing. Thus, ink flows from the upstream side to the downstream side faster than in normal printing. An ink film thickness distribution Mf (FIG. 5I) during final printing is formed quickly in the ink roller group 6.

If the ink film thickness distribution Mf during final printing is to be formed immediately from the state shown in FIG. 5E, an ink amount corresponding to the printing product of the next job is supplied without consuming ink from the end of the ink roller group 6. Therefore, the ink film thickness distribution becomes thick on the downstream side, and the density of the printing product becomes high. To decrease the density, many printing products need to be printed. To the contrary, by executing the steps in FIGS. 5F to 5H, the ink film thickness distribution can be prevented from becoming thick on the downstream side. In particular, the ink film thickness distribution Mf during final printing can be obtained quickly as an ink film thickness distribution thin on the downstream side.

[Detailed Operation of Print Job Switching Control Apparatus]

The detailed operation of the print job switching control apparatus will be explained with reference to FIGS. 6A to 6I. When switching a print job, the operator turns on the printing stop switch 16. Then, the CPU 10 confirms that the printing stop switch 16 has been turned on (YES in step S101), and outputs a sheet feed stop command to the sheet feeder 30 to stop sheet feed (step S102).

The CPU 10 outputs a throw-off signal to the valve 33 (step S103) to throw off the ink form rollers 6-1 to 6-4. That is, the ink form rollers 6-1 to 6-4 move apart from the printing plate 7.

The CPU 10 outputs a printing stop command to the printing unit 31 (step S104), and outputs a stop signal to the drive motor driver 19 to stop the drive motor 18, thereby stopping the printing press.

While the printing press stops, the ink film thickness distribution Mc corresponding to an image on the printing plate 7 remains in the ink roller group 6, as shown in FIG. 5A. That is, the ink film thickness distribution Mc of the preceding print job remains.

[Data Input]

Figure 6A:
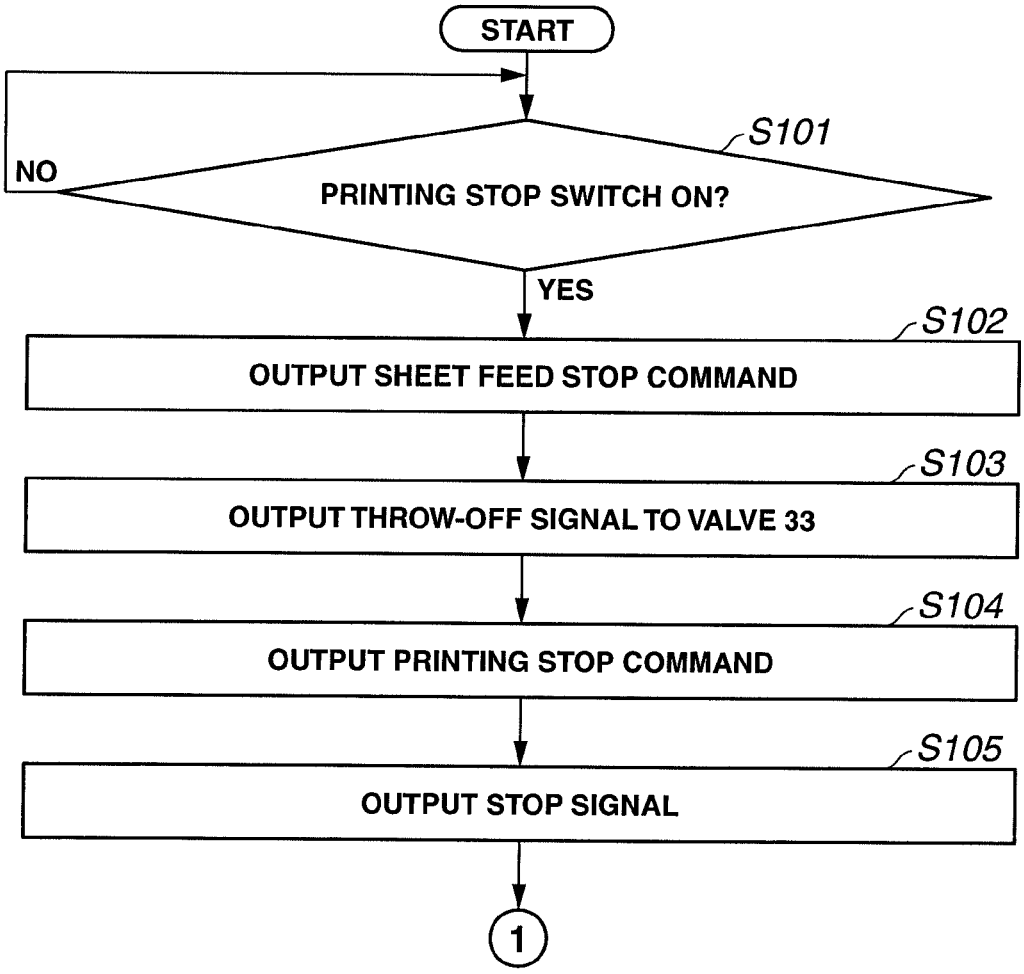
FIGS. 6A to 6I are flowcharts for explaining the detailed operation of the print job switching control apparatus shown in FIG. 1.
Figure 6B:
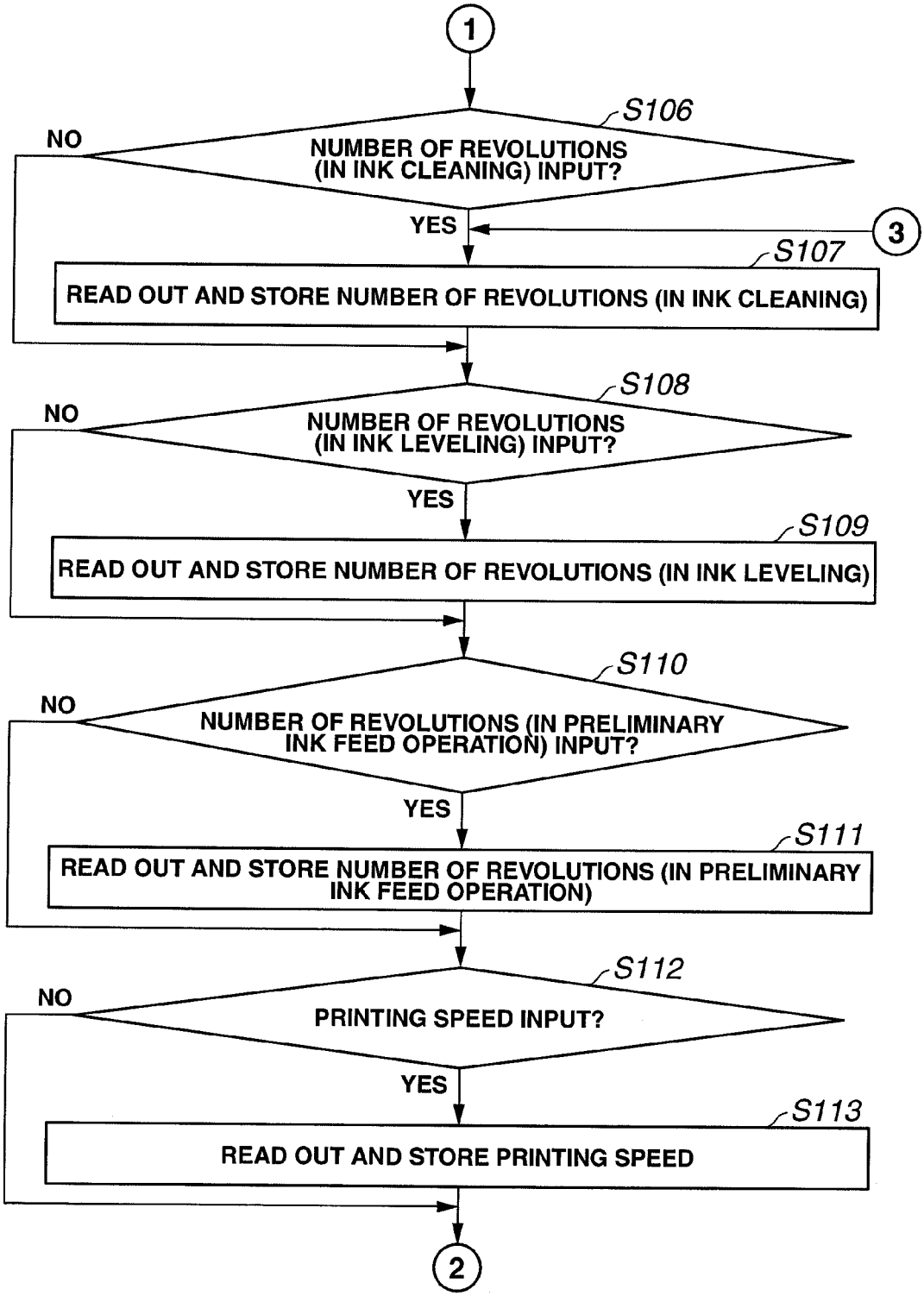

The operator inputs the number N1 of revolutions in ink cleaning, the number N2 of revolutions in ink leveling, the number N3 of revolutions in the preliminary ink feed operation, and the printing speed Vp (FIG. 6B: steps S106, S108, S110, and S112).

In this case, the number N1 of revolutions in ink cleaning is input from the number-of-revolutions setting unit 34. The number N2 of revolutions in ink leveling is input from the number-of-revolutions setting unit 35. The number N3 of revolutions in the preliminary ink feed operation is input from the number-of-revolutions setting unit 36. The printing speed Vp is input from the printing speed setting unit 37.

The CPU 10 stores, in the memory M1, the number N1 of revolutions in ink cleaning which has been input from the number-of-revolutions setting unit 34 (step S107). The CPU 10 stores, in the memory M2, the number N2 of revolutions in ink leveling which has been input from the number-of-revolutions setting unit 35 (step S109). The CPU 10 stores, in the memory M3, the number N3 of revolutions in the preliminary ink feed operation which has been input from the number-of-revolutions setting unit 36 (step S111). The CPU 10 stores, in the memory M4, the printing speed Vp which has been input from the printing speed setting unit 37 (step S113).

The CPU 10 stores, in the memory M6, the image area ratios of ranges corresponding to the ink fountain keys 4-1 to **4-*n* on the printing plate 7 that have been input from the input device 13. In the embodiment, the image area ratios of the ranges corresponding to the ink fountain keys 4-1 to 4-*n* on the printing plate 7 are measured using an image area ratio measurement apparatus as disclosed in Japanese Patent Laid-Open No. 58-201008 (literature 3) or Japanese Patent Laid-Open No. 58-201010 (literature 4). Image area ratios measured using the image area ratio measurement apparatus are written in a portable memory. The portable memory in which the image area ratios are written is set in the input device 13, inputting the image area ratios of the ranges corresponding to the ink fountain keys 4-1 to 4-*n* on the printing plate 7. Note that the CPU 10 and the image area ratio measurement apparatus may be connected online to directly receive, from the image area ratio measurement apparatus, the image area ratios of the ranges corresponding to the ink fountain keys 4-1 to 4-*n* on the printing plate 7**.

Figure 6C:
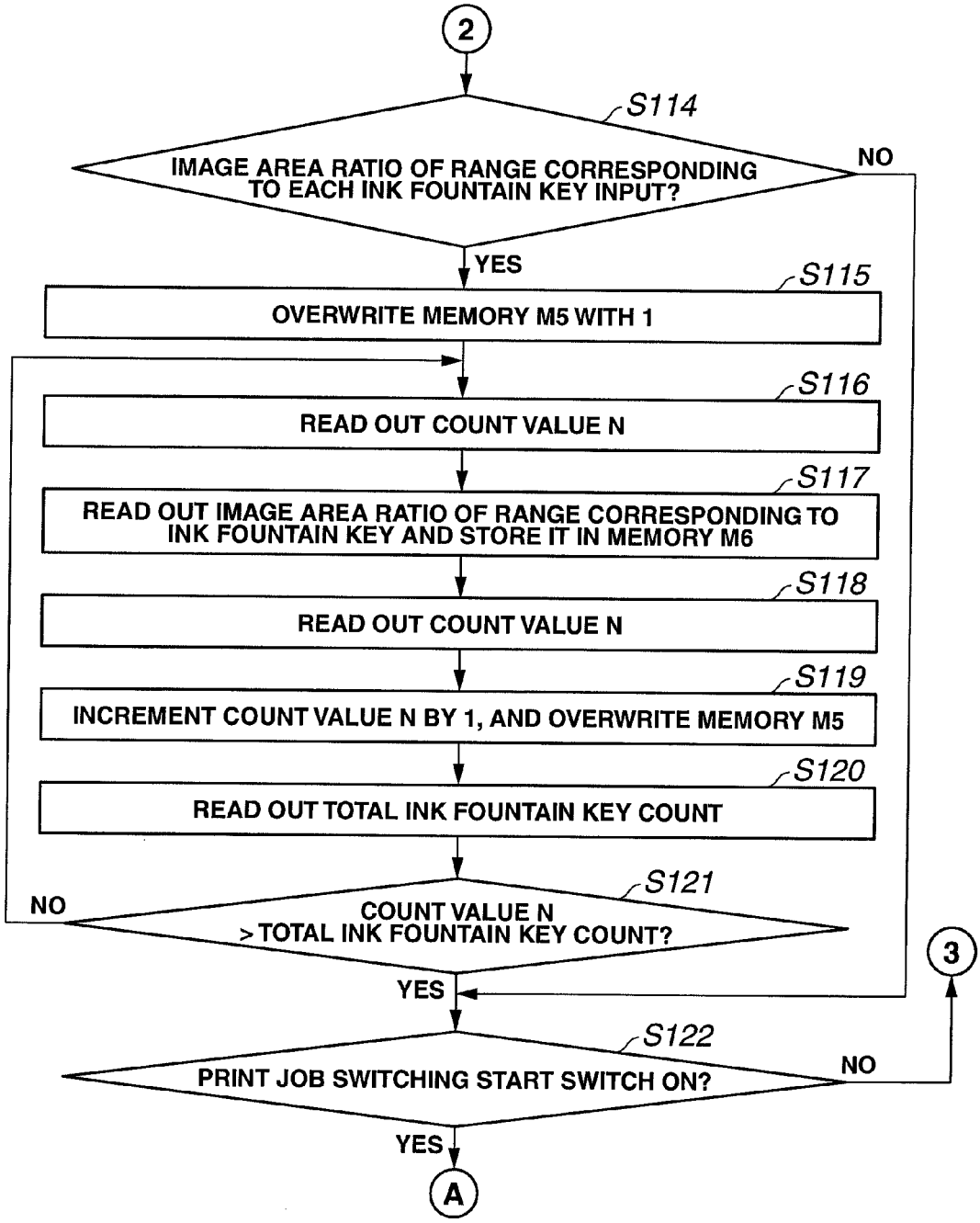

If the portable memory is set in the input device 13, that is, the image area ratios of the ranges corresponding to the ink fountain keys 4-1 to **4-*n* are input (FIG. 6C: YES in step S114), the CPU 10 overwrites the count value N in the memory M5 with N=1 (step S115), and reads out the count value N from the memory M5 (step S116). The CPU 10 reads out the image area ratio of a range corresponding to the Nth ink fountain key from the portable memory, and stores it at an address position for the Nth ink fountain key in the memory M6 (step S117**).

The CPU 10 reads out the count value N from the memory M5 (step S118), increments the count value N by one, and overwrites the memory M5 with it (step S119). The CPU 10 reads out the total ink fountain key count n from the memory M7 (step S120). The CPU 10 repeats the processing operations in steps S116 to S121 until the count value N exceeds the total ink fountain key count n (YES in step S121). As a result, the image area ratios of the respective regions corresponding to the ink fountain keys 4-1 to **4-*n* on the printing plate 7 are read out from the portable memory, and stored in the memory M6**.

[Setting of Opening Ratio of Ink Fountain Key Corresponding to Image on Printing Plate for Next Print Job]

Figure 6D:
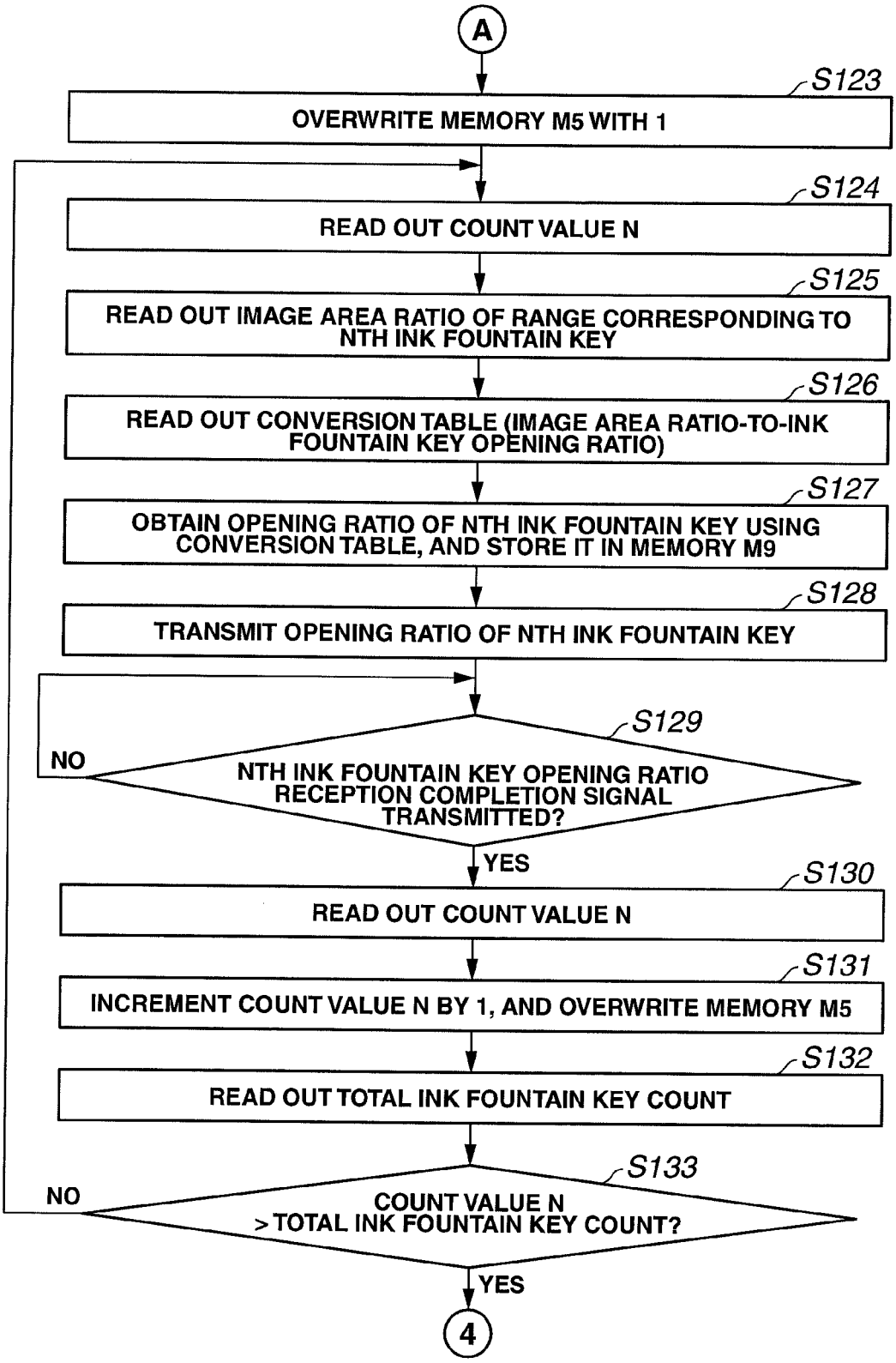
Figure 6E:
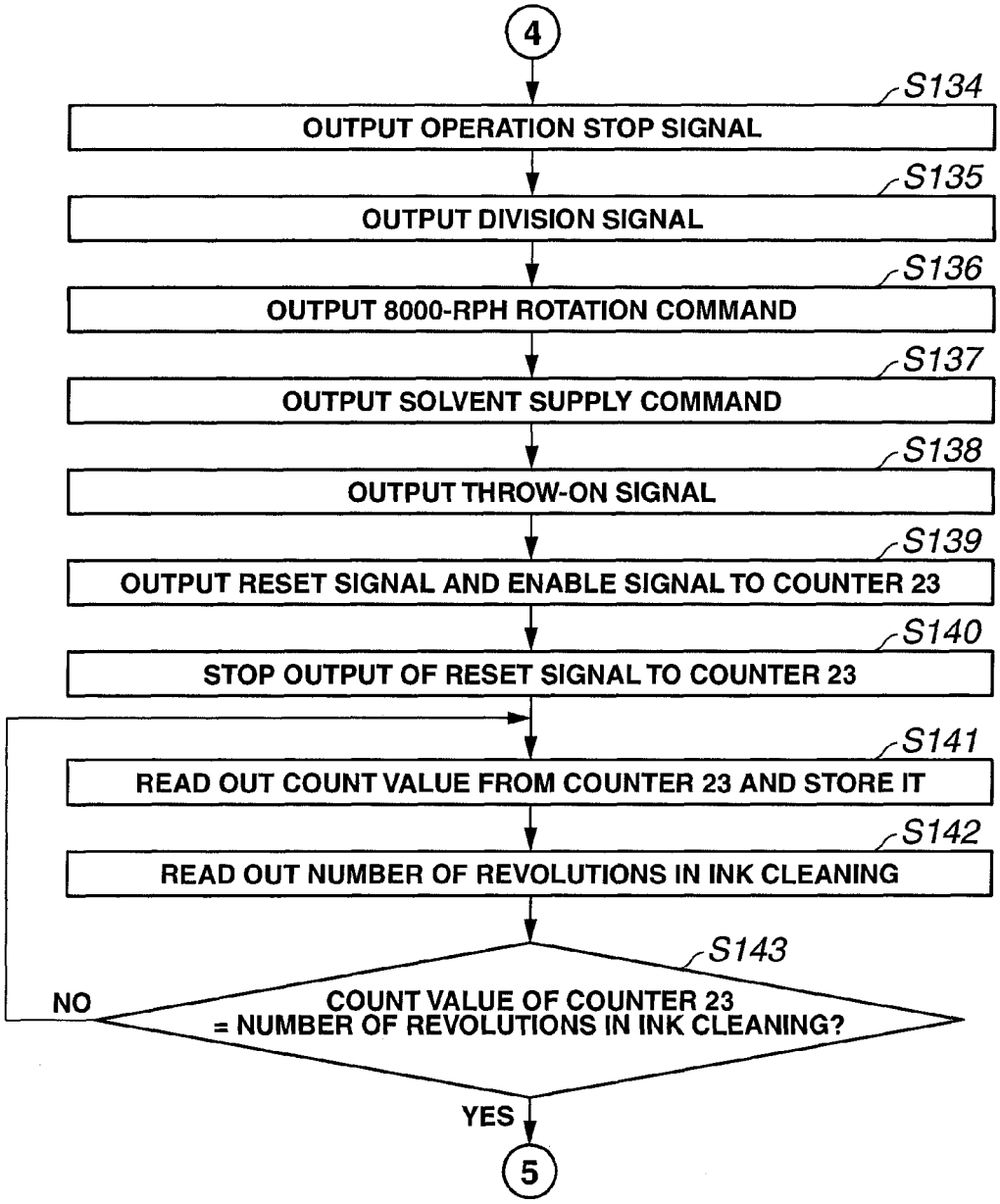

The operator turns on the print job switching switch 17. If the print job switching switch 17 has been turned on, the CPU 10 overwrites the count value N in the memory M5 with N=1 (FIG. 6D: step S123). The CPU 10 reads out the count value N from the memory M5 (step S124), and reads out the image area ratio of the range corresponding to the Nth ink fountain key from the address position for the Nth ink fountain key in the memory M6 (step S125).

The CPU 10 reads out the image area ratio-to-ink fountain key opening ratio conversion table from the memory M8 (step S126). By using the image area ratio-to-ink fountain key opening ratio conversion table, the CPU 10 obtains the opening ratio of the Nth ink fountain key from the image area ratio of the range corresponding to the Nth ink fountain key. The CPU 10 stores the obtained opening ratio of the Nth ink fountain key at an address position for the Nth ink fountain key in the memory M9 (step S127), and transmits it to the Nth ink fountain key control apparatus 300 (step S128).

The CPU 10 confirms that the Nth ink fountain key control apparatus 300 has transmitted an Nth ink fountain key opening ratio reception completion signal (YES in step S129). Then, the CPU 10 reads out the count value N from the memory M5 (step S130), increments the count value N by one, and overwrites the memory M5 with it (step S131). The CPU 10 reads out the total ink fountain key count n from the memory M7 (step S132). The CPU 10 repeats the processing operations in steps S124 to S133 until the count value N exceeds the total ink fountain key count n (YES in step S133).

Accordingly, the opening ratios of the ink fountain keys 4-1 to **4-*n* that correspond to the image area ratios of the ranges corresponding to the ink fountain keys 4-1 to 4-*n* on the printing plate 7' are obtained, stored in the memory M9, and transmitted to the ink fountain key control apparatuses 300-1 to 300-*n***.

[Division of Ink Roller Group]

The CPU 10 outputs an operation stop signal to the ink ductor device 24 (FIG. 6E: step S134) to stop the ink feed operation of the ink ductor roller 5. The CPU 10 outputs a division signal to the roller group division/coupling pneumatic cylinder valve 26 (step S135) to divide the ink roller group 6 into the upstream roller subgroup 6A and downstream roller subgroup 6B (see FIG. 3).

As shown in FIG. 5B, the ink film thickness distribution Mc of the ink roller group 6 is divided into the ink film thickness distribution McA of the upstream roller subgroup 6A and the ink film thickness distribution McB of the downstream roller subgroup 6B.

[Cleaning of Ink in Upstream Roller Subgroup]

The CPU 10 outputs an 8000-rph rotation command to the drive motor driver 19 via the D/A converter 21 (step S136). In response to this, the printing press starts rotating, and its speed rises up to 8,000 rph. The CPU 10 outputs a solvent supply command to the solvent supply device 27 (step S137), and outputs a throw-on signal to the doctor throw-on/off pneumatic cylinder valve 29 (step S138). The solvent supply device 27 injects a solvent, and the doctor 41 comes into contact with the outer surface of the roller 6A2, starting cleaning of ink in the upstream roller subgroup 6A.

The CPU 10 keeps cleaning the ink in the upstream roller subgroup 6A until the number of revolutions of the printing press reaches the number N1 of revolutions in ink cleaning in the memory M1. More specifically, the CPU 10 outputs a throw-on signal to the valve 29 (step S138), and outputs a reset signal and enable signal to the counter 23 (step S139). The CPU 10 then stops the output of the reset signal to the counter (step S140), and starts the count operation of the counter 23 from 0. The CPU 10 reads out the count value of the counter 23, and stores it in the memory M11 (step S141). The CPU 10 reads out the number N1 of revolutions in ink cleaning from the memory M1 (step S142). The CPU 10 repeats the processing operations in steps S141 to S143 until the count value of the counter 23 for counting the number of revolutions of the printing press reaches the number N1 of revolutions in ink cleaning (YES in step S143).

Figure 6F:
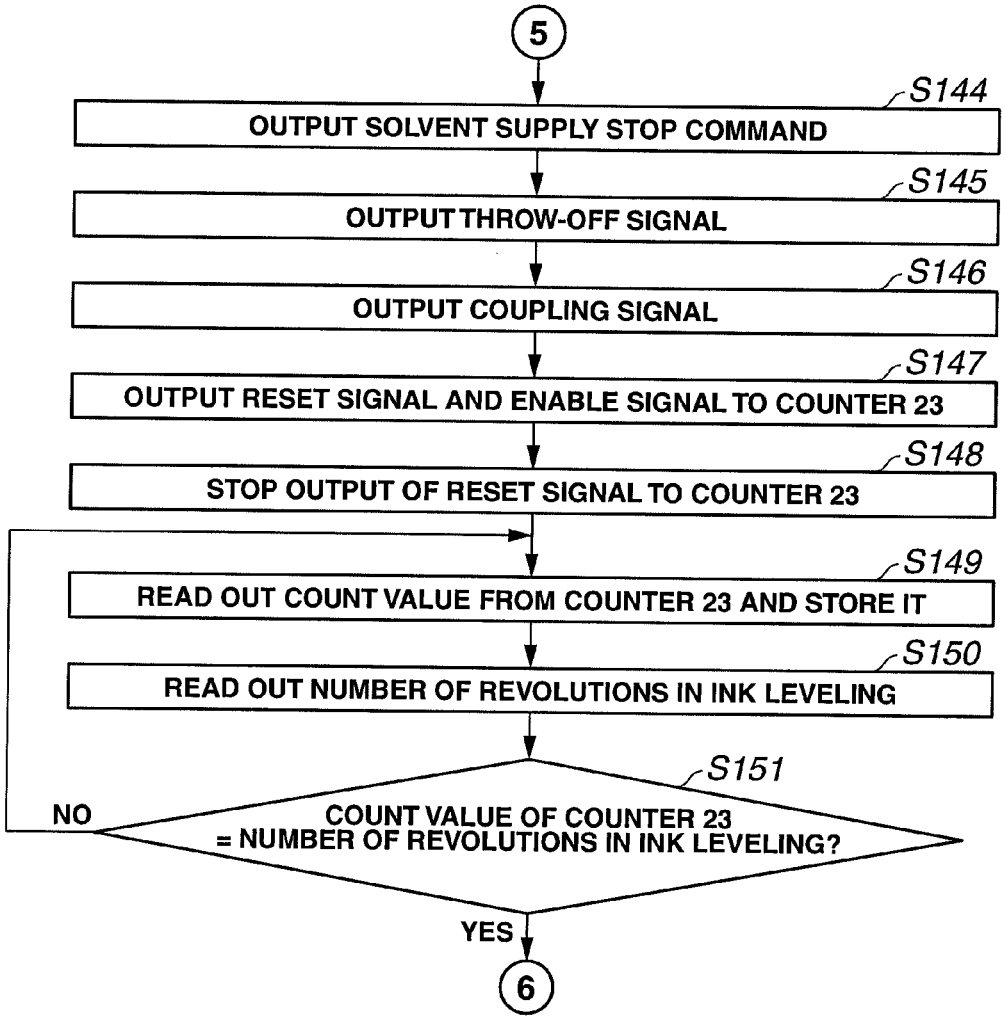
Figure 6G:
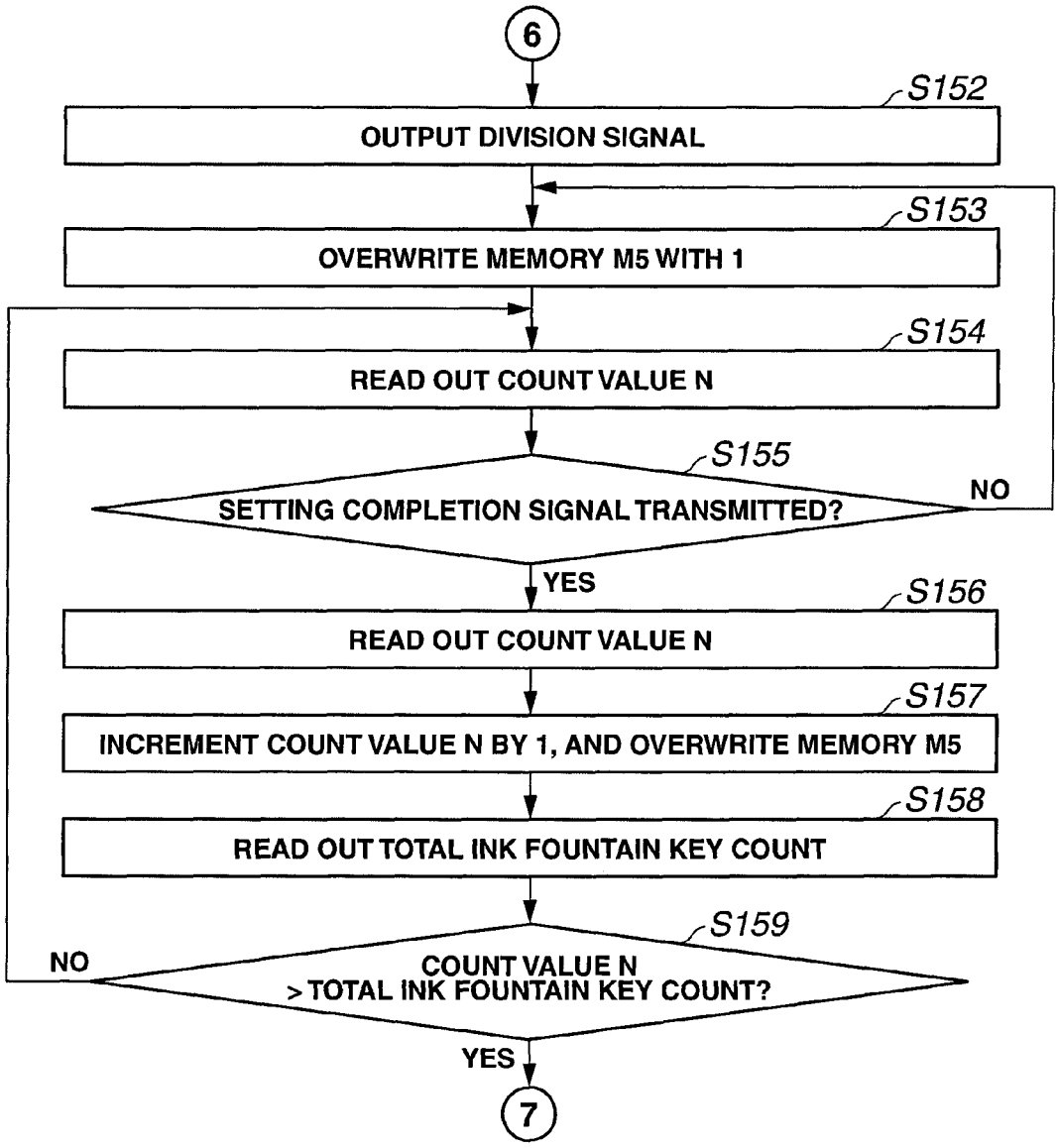

If the count value of the counter 23 reaches the number N1 of revolutions in ink cleaning (YES in step S143), the CPU 10 outputs a solvent supply stop command to the solvent supply device 27 (FIG. 6F: step S144). The CPU 10 outputs a throw-off signal to the valve 29 (step S145), completing the cleaning of the ink in the upstream roller subgroup 6A.

As shown in FIG. 5C, the ink film thickness distribution McA of the upstream roller subgroup 6A becomes almost 0. At this time, the ink film thickness distribution of the downstream roller subgroup 6B is leveled by the number N1 of revolutions in ink cleaning, obtaining the flat ink film thickness distribution McB'.

[Coupling of Ink Roller Group]

The CPU 10 outputs a coupling signal to the valve 26 (step S146) to couple the upstream roller subgroup 6A and downstream roller subgroup 6B (see FIG. 2), and return them to the single ink roller group 6 (FIG. 5D).

The CPU 10 outputs a reset signal and enable signal to the counter 23 (step S147). Then, the CPU 10 stops the output of the reset signal to the counter 23 (step S148), and starts the count operation of the counter 23 from 0. The CPU 10 reads out the count value of the counter 23, and stores it in the memory M11 (step S149). The CPU 10 reads out the number N2 of revolutions in ink leveling from the memory M2 (step S150). The CPU 10 repeats the processing operations in steps S149 to S151 until the count value of the counter 23 reaches the number N2 of revolutions in ink leveling (YES in step S151).

Accordingly, the ink film thickness distribution McB' remaining in the downstream roller subgroup 6B is leveled between the downstream roller subgroup 6B and the upstream roller subgroup 6A, forming the thin, flat ink film thickness distribution (basic ink film thickness distribution) Md (FIG. 5E) in the ink roller group 6.

[Redivision of Ink Roller Group]

Figure 3:
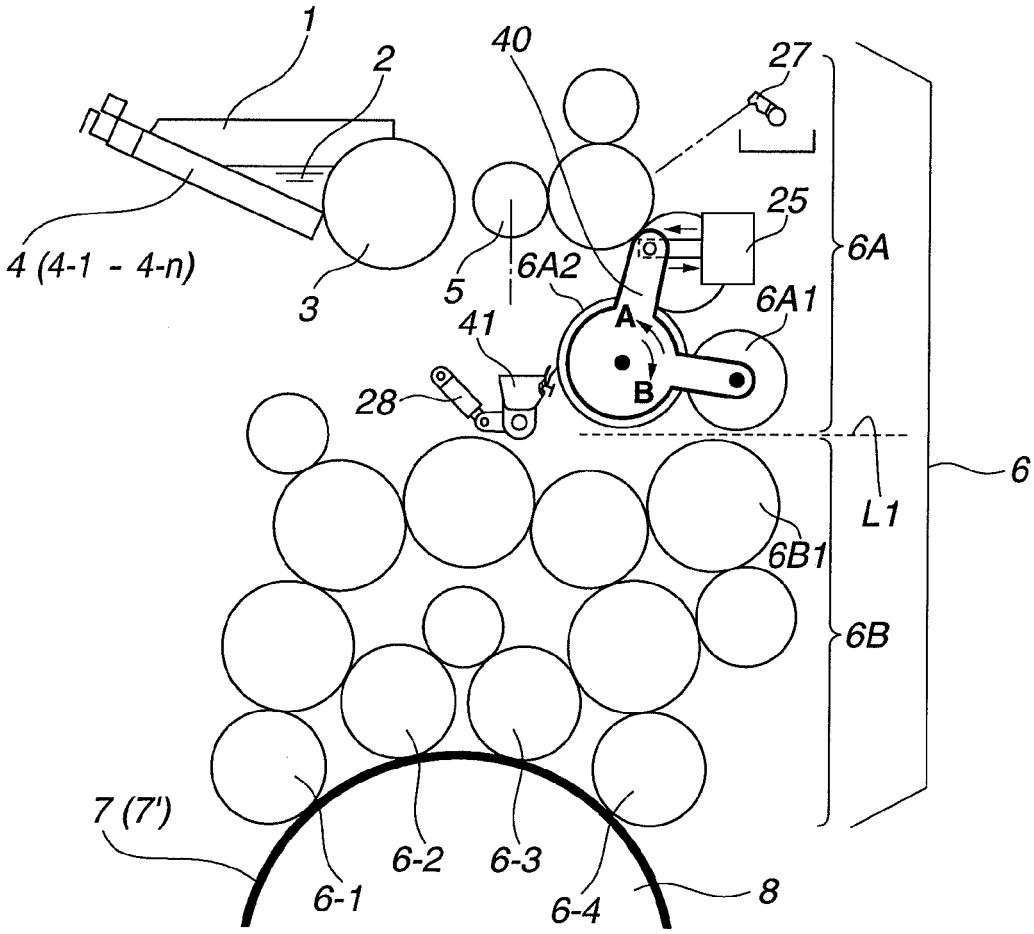
FIG. 3 is a view showing the main part (state in which the ink roller group is divided) of the ink supply apparatus to be controlled by the print job switching control apparatus shown in FIG. 1.

If the count value of the counter 23 reaches the number N2 of revolutions in ink leveling (YES in step S151), the CPU 10 outputs a division signal to the valve 26 (FIG. 6G: step S152) to divide again the ink roller group 6 into the upstream roller subgroup 6A and downstream roller subgroup 6B (see FIG. 3).

As shown in FIG. 5F, the ink film thickness distribution Md of the ink roller group 6 is divided into the basic ink film thickness distribution MdA of the upstream roller subgroup 6A and the basic ink film thickness distribution MdB of the downstream roller subgroup 6B.

[Confirmation of Completion of Setting Opening Ratio of Ink Fountain Key]

The CPU 10 overwrites the count value N in the memory M5 with N=1 (step S153), and reads out the count value N from the memory M5 (step S154). The CPU 10 confirms the presence/absence of an ink fountain key opening ratio setting completion signal from the Nth ink fountain key control apparatus 300 (step S155).

If the CPU 10 confirms that the Nth ink fountain key control apparatus 300 has transmitted the ink fountain key opening ratio setting completion signal (YES in step S155), the CPU 10 reads out the count value N from the memory M5 (step S156). The CPU 10 increments the count value N by one, and overwrites the memory M5 with it (step S157). The CPU 10 reads out the total ink fountain key count n from the memory M7 (step S158). The CPU 10 repeats the processing operations in steps S154 to S159 until the count value N exceeds the total ink fountain key count n (YES in step S159).

Figure 6H:
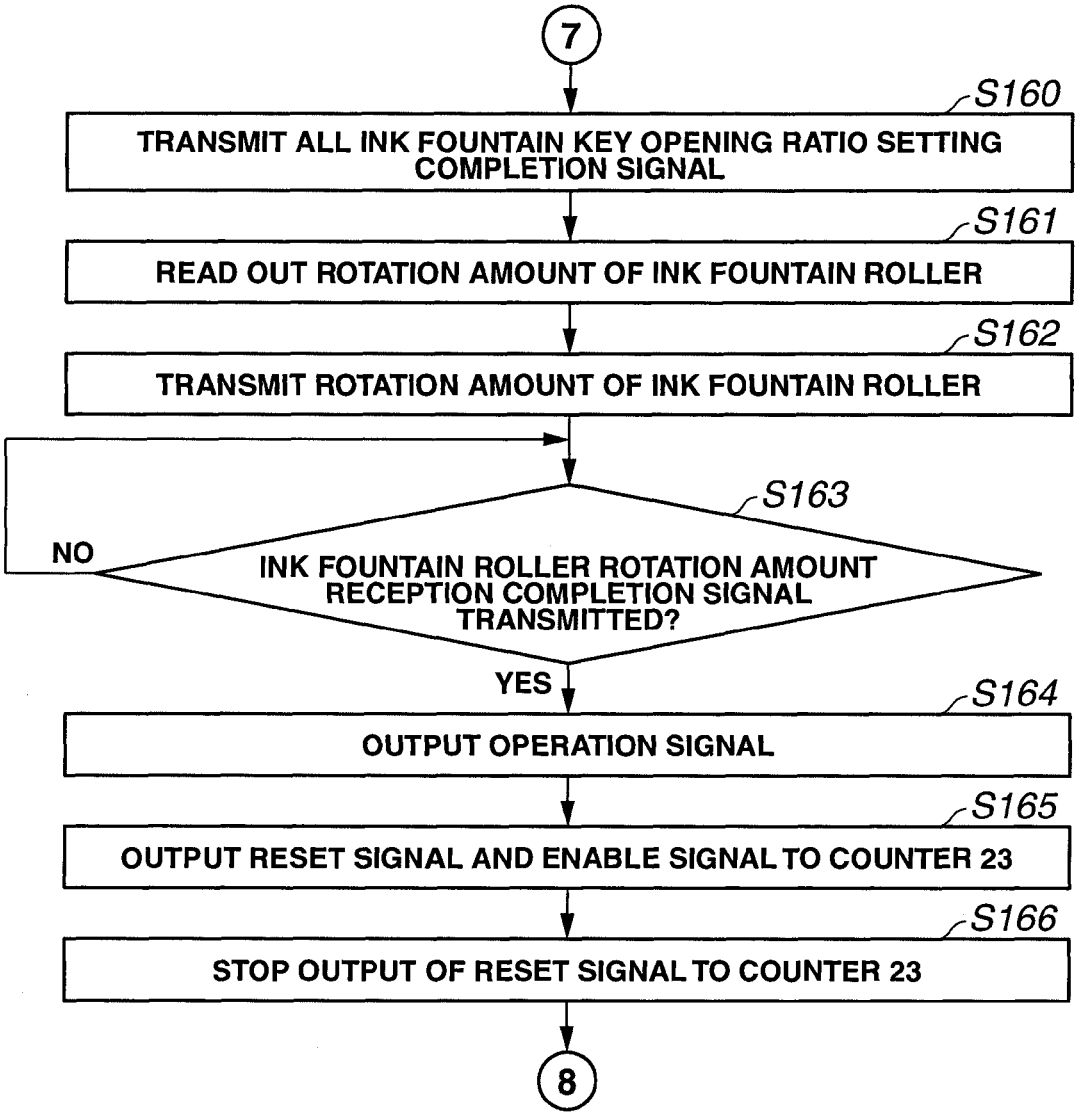

If the count value N exceeds the total ink fountain key count n (YES in step S159), the CPU 10 determines that the setting of the opening ratios of the ink fountain keys has been completed. The CPU 10 transmits an all ink fountain key opening ratio setting completion signal to all the ink fountain key control apparatuses 300 (300-1 to **300-*n*) (FIG. 6H: step S160**).

[Preliminary Ink Feed]

After transmitting the all ink fountain key opening ratio setting completion signal to all the ink fountain key control apparatuses 300 (step S160), the CPU 10 reads out the rotation amount of the ink fountain roller that is stored in the memory M10 (step S161). The CPU 10 transmits the readout rotation amount of the ink fountain roller to the ink fountain roller control apparatus 200 (step S162).

If the CPU 10 receives an ink fountain roller rotation amount reception completion signal from the ink fountain roller control apparatus 200 (YES in step S163), it outputs an operation signal to the ink ductor device 24 (step S164), and starts the ink feed operation of the ink ductor roller 5. The CPU 10 continues the ink feed operation of the ink ductor roller 5 until the number of revolutions of the printing press reaches the number N3 of revolutions in the preliminary ink feed operation in the memory M3.

Figure 6I:
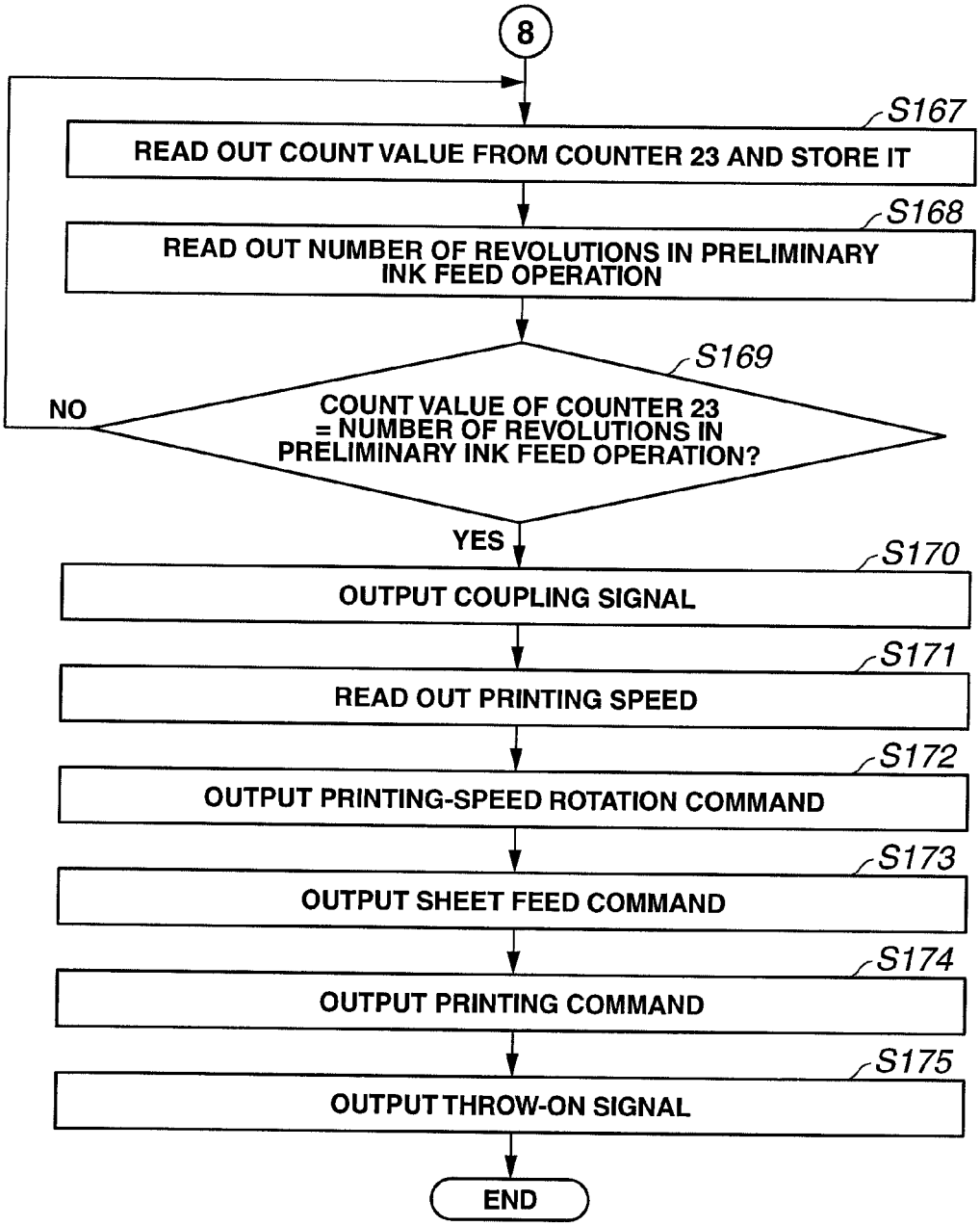

More specifically, the CPU 10 outputs a reset signal and enable signal to the counter 23 (step S165). The CPU 10 stops the output of the reset signal to the counter 23 (step S166), and starts, from 0, the count operation of the counter 23. The CPU 10 reads out the count value of the counter 23, and stores it in the memory M11 (FIG. 6I: step S167). The CPU 10 reads out the number N3 of revolutions in the preliminary ink feed operation from the memory M3 (step S168). The CPU 10 repeats the processing operations in steps S167 to S169 until the count value of the counter 23 reaches the number N3 of revolutions in the preliminary ink feed operation (YES in step S169).

As a result, the ink film thickness distribution MeA in preliminary ink feed is formed in the upstream roller subgroup 6A (FIG. 5G).

[Recoupling of Ink Roller Group]

If the count value of the counter 23 reaches the number N3 of revolutions in the preliminary ink feed operation (YES in step S169), the CPU 10 outputs a coupling signal to the valve 26 (step S170) to couple again the upstream roller subgroup 6A and downstream roller subgroup 6B (see FIG. 3), and return them to the single ink roller group 6 (FIG. 5H).

[Printing of Next Job]

The CPU 10 reads out the printing speed Vp from the memory M4 (step S171). The CPU 10 outputs a printing-speed rotation command to the motor driver 19 via the D/A converter 21 (step S172), and sets the printing speed Vp as the speed of the printing press. The CPU 10 outputs a sheet feed command to the sheet feeder 30 (step S173) to start sheet feed to the printing press. The CPU 10 outputs a printing command to the printing unit 31 (step S174). In addition, the CPU 10 outputs a throw-on signal to the valve 33 (step S175) to throw on the ink form rollers 6-1 to 6-4. The CPU 10 starts a print job using the next printing plate 7'.

In this case, an ink film thickness distribution (ink film thickness distribution in final printing) in printing using the next printing plate 7' is formed during printing, that is, while consuming ink from the end of the ink roller group 6. At this time, the ink film thickness distribution MdB in the downstream roller subgroup 6B becomes thinner than that during normal printing. Thus, ink flows from the upstream side to the downstream side faster than in normal printing. The ink film thickness distribution Mf (FIG. 5I) during final printing is formed quickly in the ink roller group 6.

[Ink Fountain Roller Control Apparatus]

Figure 7:
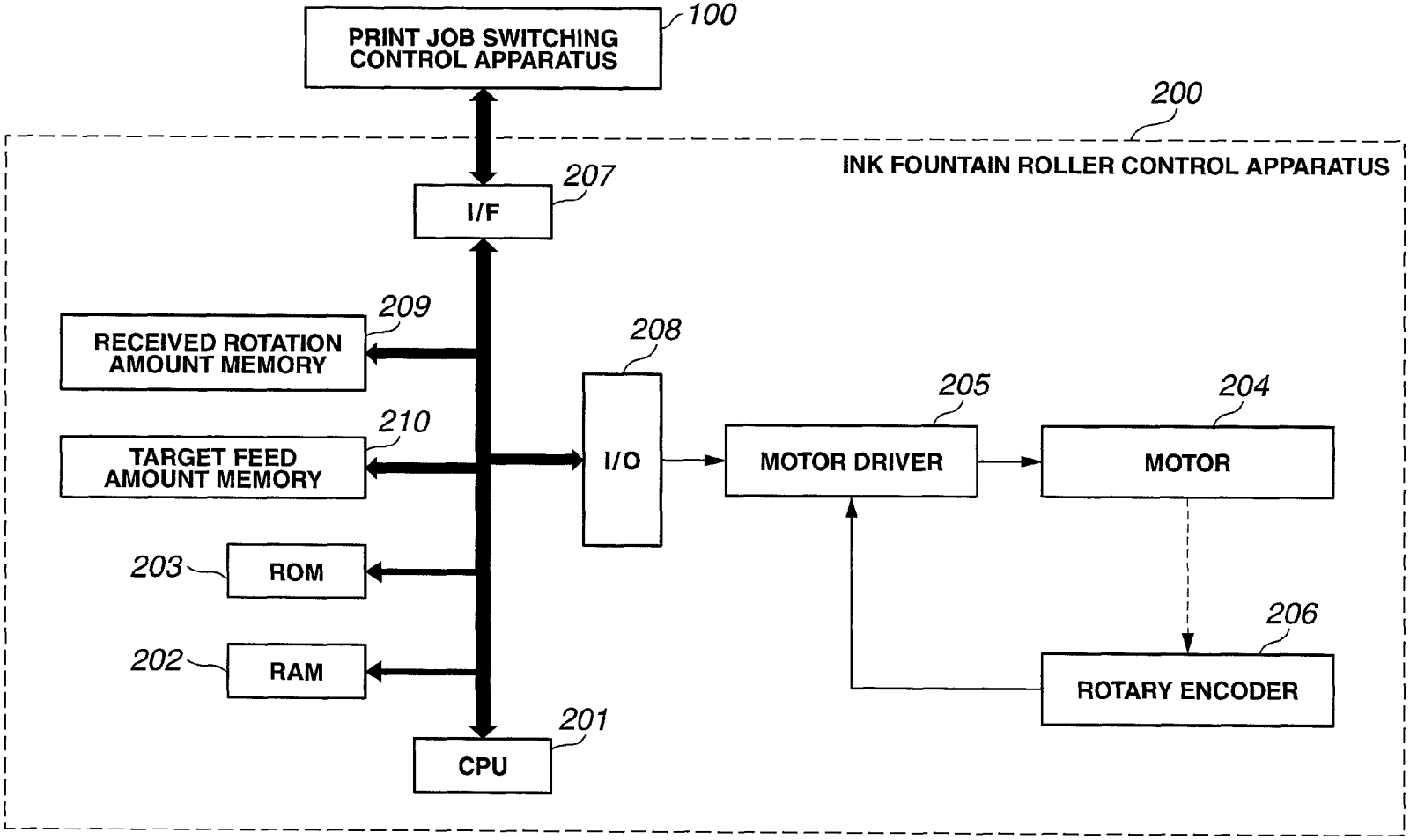
FIG. 7 is a block diagram showing the detailed arrangement of an ink fountain roller control apparatus shown in FIG. 1.

As shown in FIG. 7, the ink fountain roller control apparatus 200 includes a CPU 201, a RAM 202, a ROM 203, an ink fountain roller drive motor 204, an ink fountain roller drive motor driver 205, an ink fountain roller drive motor rotary encoder 206, input/output interfaces (I/O I/Fs) 207 and 208, and memories 209 and 210. The ink fountain roller control apparatus 200 is connected to the print job switching control apparatus 100 via the interface 207. The memory 209 stores a received rotation amount of the ink fountain roller. The memory 210 stores the target feed amount of the ink fountain roller.

Figure 8:
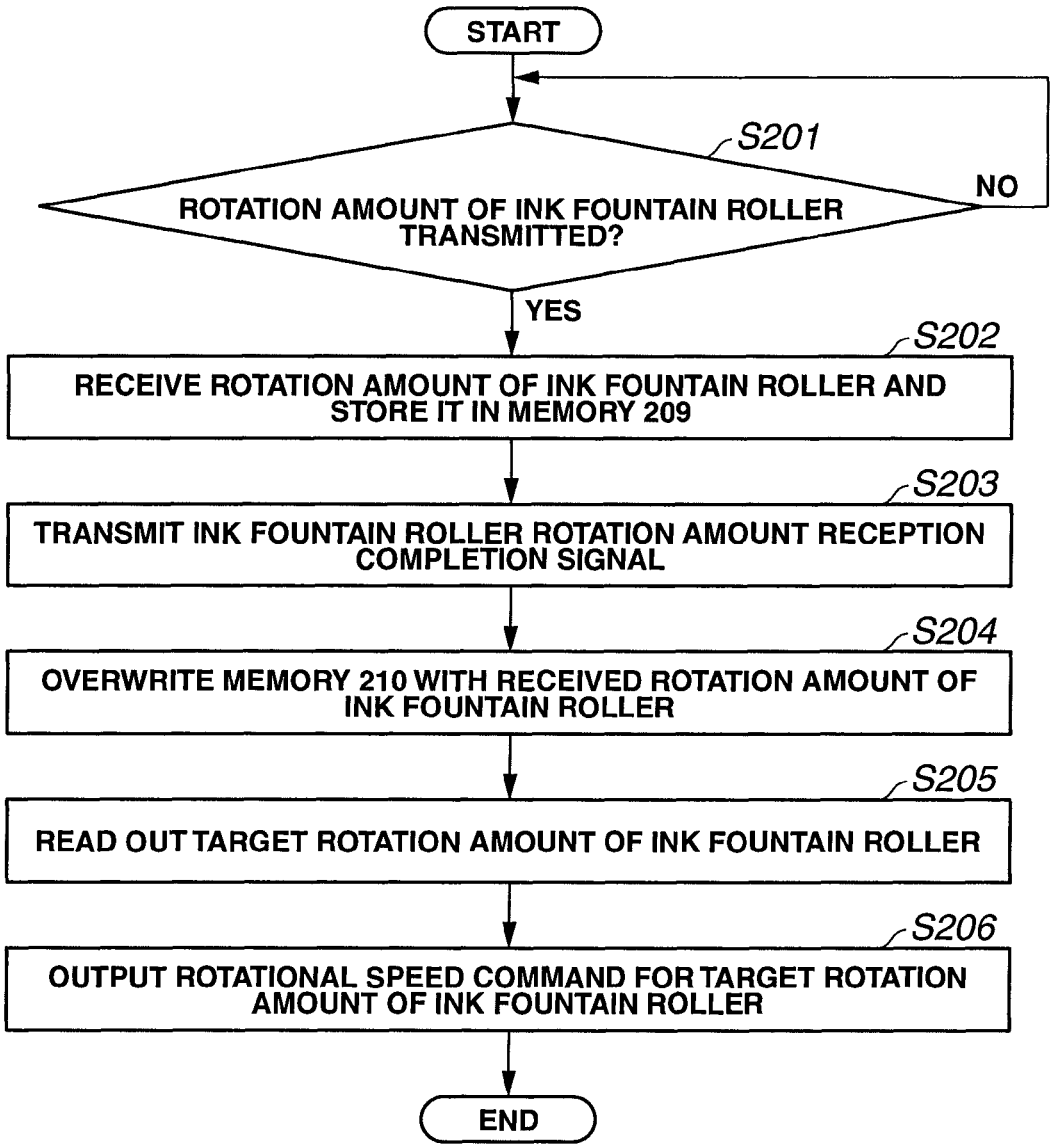
FIG. 8 is a flowchart showing the processing operation of the ink fountain roller control apparatus shown in FIG. 7.

If the print job switching control apparatus 100 has transmitted the rotation amount of the ink fountain roller (FIG. 8: YES in step S201), the CPU 201 stores the received rotation amount in the memory 209 (step S202). The CPU 201 then transmits an ink fountain roller rotation amount reception completion signal to the print job switching control apparatus 100 (step S203). The CPU 201 stores the received rotation amount of the ink fountain roller as the target feed amount (target rotation amount) of the ink fountain roller in the memory 210 (step S204). The CPU 201 reads out the target rotation amount from the memory 210 (step S205), sends it to the motor driver 205, and adjusts the rotation amount of the ink fountain roller drive motor 204 to coincide with the target rotation amount (step S206).

[Ink Fountain Key Control Apparatus]

Figure 9:
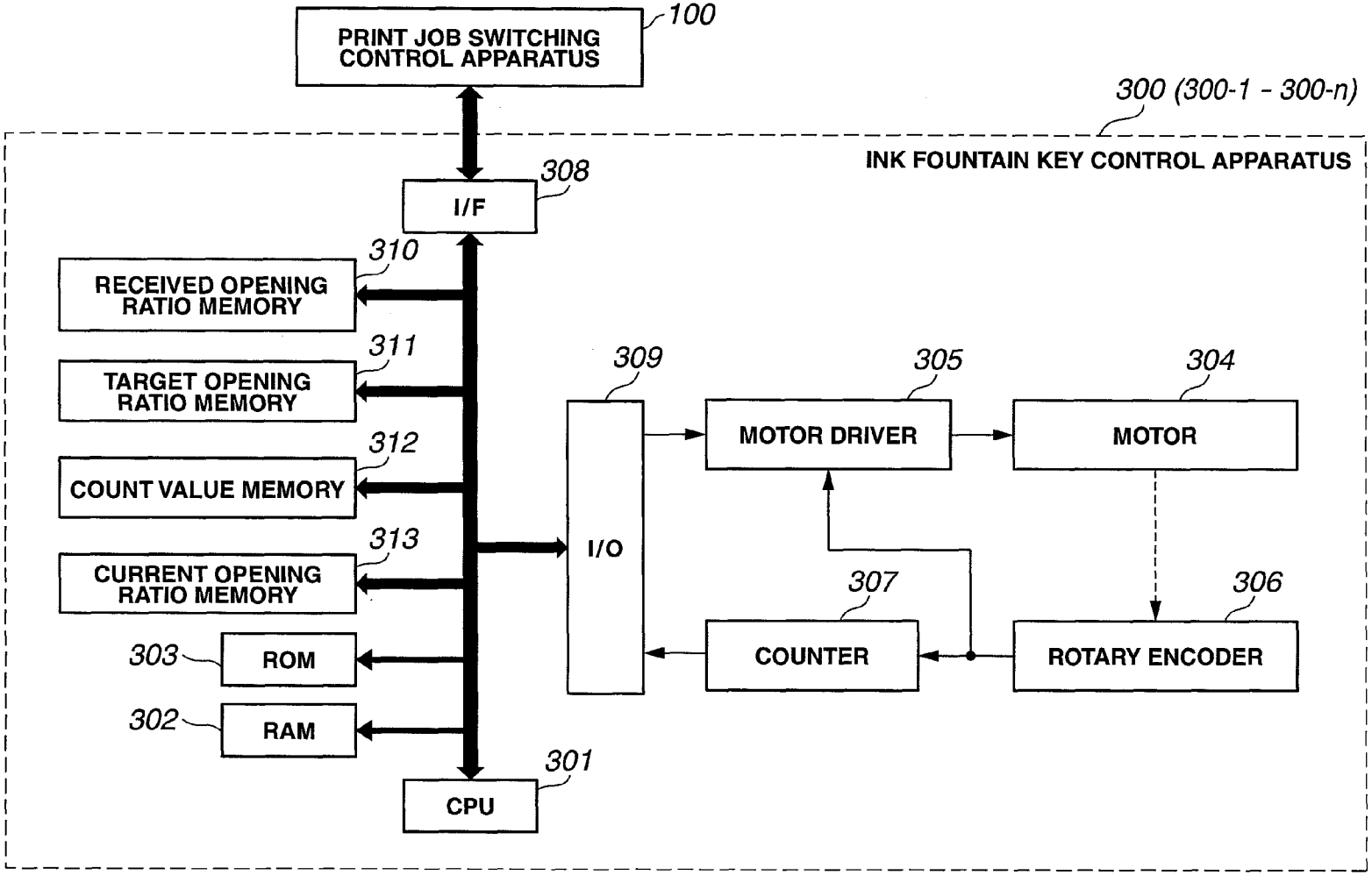
FIG. 9 is a block diagram showing the detailed arrangement of an ink fountain key control apparatus shown in FIG. 1.

As shown in FIG. 9, the ink fountain key control apparatus 300 includes a CPU 301, a RAM 302, a ROM 303, an ink fountain key drive motor 304, an ink fountain key drive motor driver 305, an ink fountain key drive motor rotary encoder 306, a counter 307, input/output interfaces (I/O I/Fs) 308 and 309, and memories 310 to 313. The ink fountain key control apparatus 300 is connected to the print job switching control apparatus 100 via the interface 308. The memory 310 stores a received opening ratio of the ink fountain key. The memory 311 stores the target opening ratio of the ink fountain key. The memory 312 stores the count value of the counter 307. The memory 313 stores the current opening ratio of the ink fountain key.

Figure 10A:
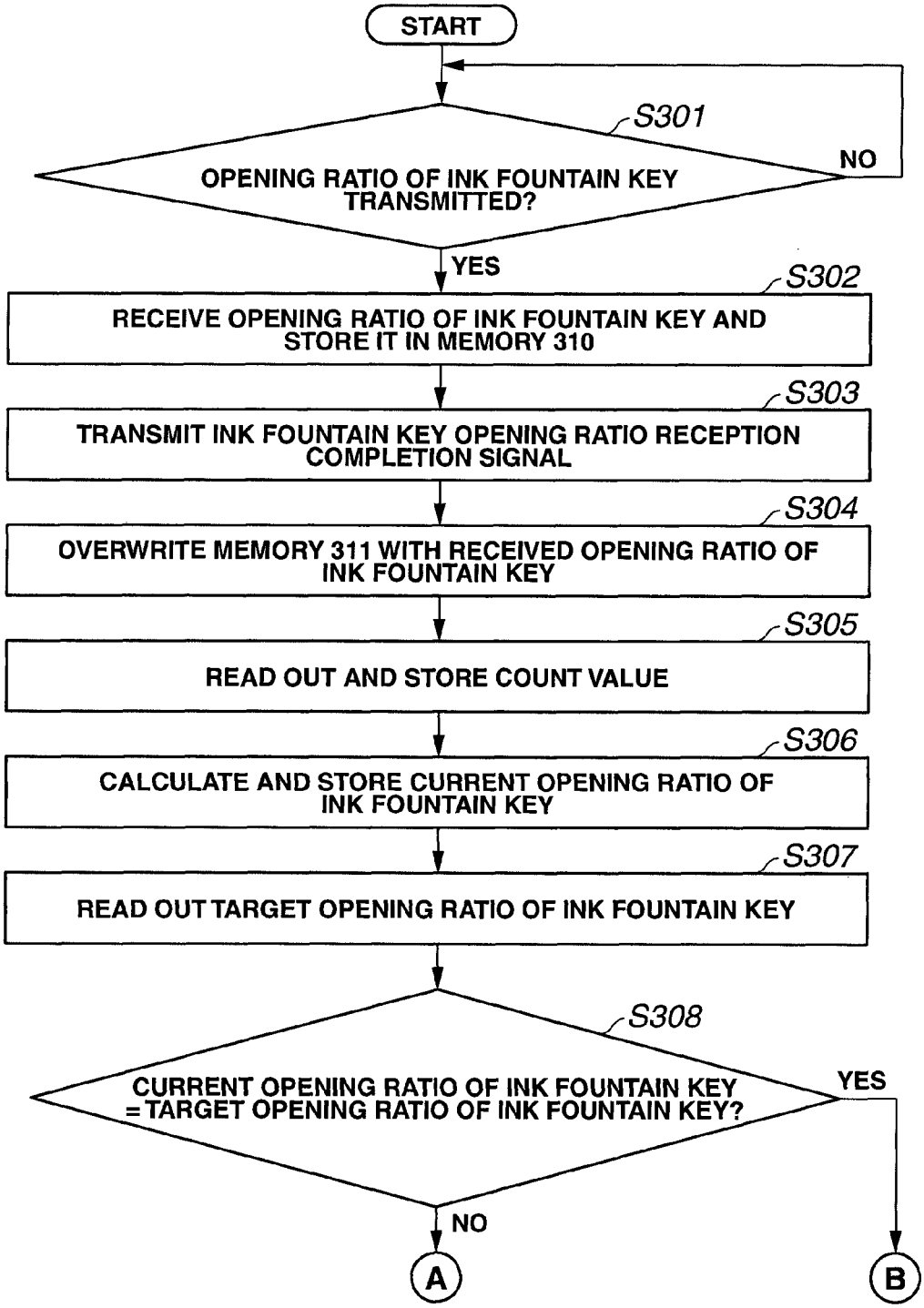
FIGS. 10A and 10B are flowcharts showing the processing operation of the ink fountain key control apparatus shown in FIG. 8.

If the print job switching control apparatus 100 has transmitted the opening ratio of the ink fountain roller (FIG. 10A: YES in step S301), the CPU 301 stores the received opening ratio in the memory 310 (step S302). The CPU 201 then transmits an ink fountain key opening ratio reception completion signal to the print job switching control apparatus 100 (step S303). The CPU 201 stores the received opening ratio of the ink fountain key as a target opening ratio in the memory 311 (step S304).

Figure 10B:
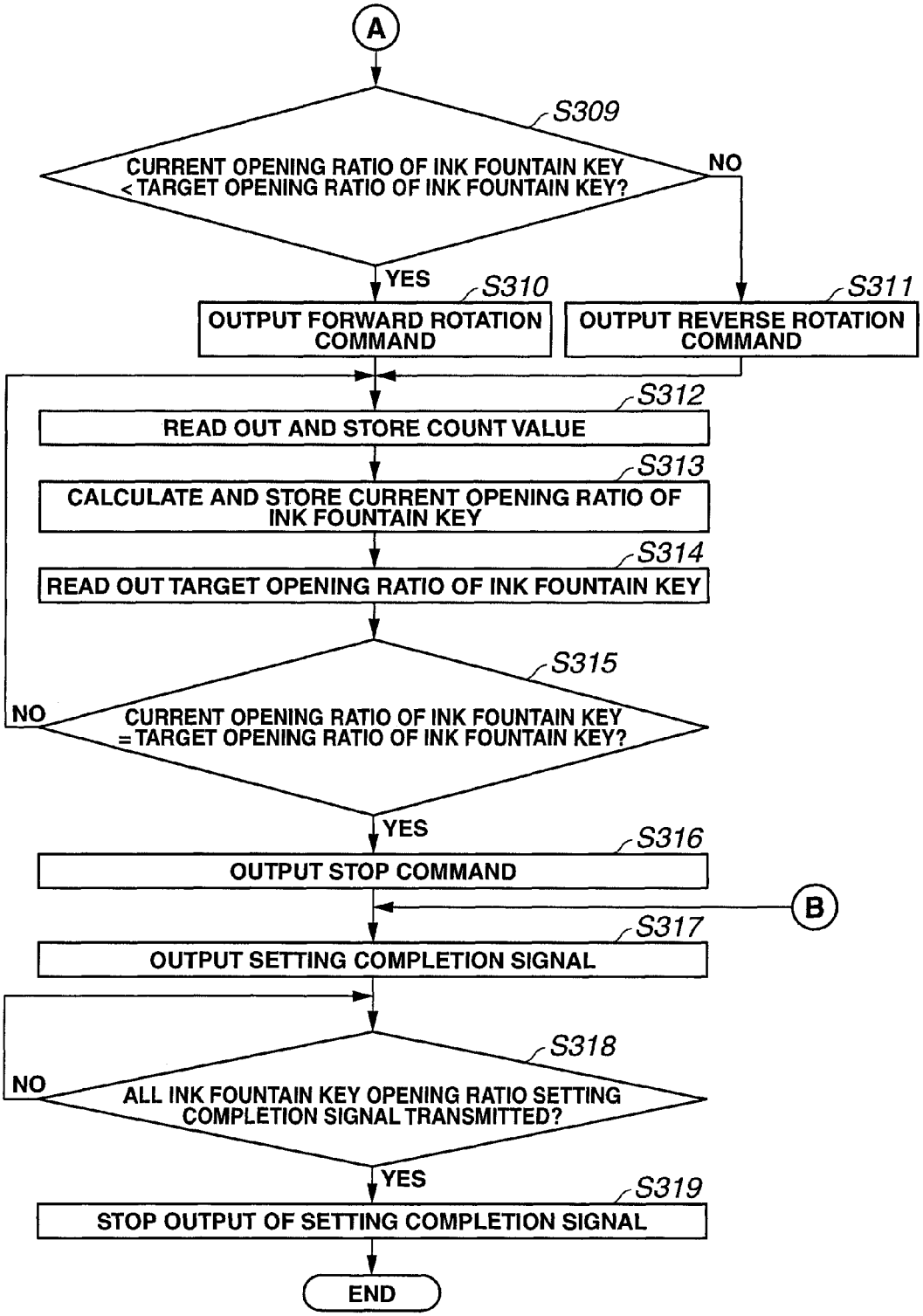

The CPU 301 reads the count value of the counter 307 and stores it in the memory 312 (step S305). The CPU 301 obtains the current opening ratio of the ink fountain key from the read count value of the counter 307, and stores it in the memory 313 (step S306). The CPU 301 reads out the target opening ratio of the ink fountain key from the memory 311 (step S307). If the current opening ratio of the ink fountain key is equal to the target opening ratio (YES in step S308), the process directly advances to step S317 (FIG. 10B). The CPU 301 outputs an ink fountain key opening ratio setting completion signal to the print job switching control apparatus 100.

If the current opening ratio of the ink fountain key is different from the target opening ratio (NO in step S308), the CPU 301 drives the motor 304 until the current opening ratio of the ink fountain key becomes equal to the target opening ratio (steps S309 to S316). After that, the CPU 301 outputs an ink fountain key opening ratio setting completion signal to the print job switching control apparatus 100 (step S317).

More specifically, if the current opening ratio of the ink fountain key is lower than the target opening ratio (YES in step S309), the CPU 301 sends a forward rotation command to the motor driver 305 (step S310). The CPU 301 reads out the count value from the counter 307 (step S312), and calculates the current opening ratio of the ink fountain key from the count value (step S313). The CPU 301 reads out the target opening ratio of the ink fountain key from the memory 311 (step S314). The CPU 301 repeats the processing operations in steps S312 to S315 until the current opening ratio of the ink fountain key coincides with the target opening ratio of the ink fountain key (YES in step S315).

If the current opening ratio of the ink fountain key is higher than the target opening ratio (NO in step S309), the CPU 301 sends a reverse rotation command to the motor driver 305 (step S311). The CPU 301 reads out the count value from the counter 307 (step S312), and calculates the current opening ratio of the ink fountain key from the count value (step S313). The CPU 301 reads out the target opening ratio of the ink fountain key from the memory 311 (step S314). The CPU 301 repeats the processing operations in steps S312 to S315 until the current opening ratio of the ink fountain key coincides with the target opening ratio (YES in step S315).

If the current opening ratio of the ink fountain key coincides with the target opening ratio of the ink fountain key in step S315 (YES in step S315), the CPU 301 outputs a stop command to the ink fountain key drive motor driver 305 (step S316), and outputs an ink fountain key opening ratio setting completion signal to the print job switching control apparatus 100 (step S317).

After outputting the ink fountain key opening ratio setting completion signal to the print job switching control apparatus 100 (step S317), the CPU 301 stops the output of the ink fountain key opening ratio setting completion signal to the print job switching control apparatus 100 (step S319) upon receiving an all ink fountain key opening ratio setting completion signal from the print job switching control apparatus 100 (YES in step S318).

In the above-described embodiment, the ink roller group 6 is divided into the two, upstream roller subgroup 6A and downstream roller subgroup 6B. However, the ink roller group 6 may be divided into a larger number of subgroups such as three or four. Although ink in some of the divided roller subgroups is removed, ink may be removed from a plurality of roller subgroups as long as these roller subgroups are some of the divided roller subgroups.

In the above-described embodiment, the ink roller group 6 is divided and coupled using the swing arm 40. However, the mechanism of dividing and coupling the ink roller group 6 is not limited to the mechanism using the swing arm.

As described above, according to the present invention, while the ink form rollers are thrown off after the end of a print job using a preceding printing plate (after the end of a preceding print job), and the ink feed operation of the ink ductor roller is stopped, the ink roller group is divided into a plurality of roller subgroups. Then, ink in some of the divided roller subgroups is removed. Although the ink roller group is divided into a plurality of roller subgroups in the present invention, the number of roller subgroups is arbitrary if it is two or more. Although ink in some of the divided roller subgroups is removed in the present invention, ink may be removed from a plurality of roller subgroups as long as these roller subgroups are some of the divided roller subgroups.

For example, in an arrangement capable of dividing the ink roller group into two roller subgroups, the ink roller group is divided into upstream and downstream roller subgroups. Ink is removed from some of the divided roller subgroups, e.g., the upstream roller subgroup. In this case, the ink in the upstream roller subgroup cannot be returned to the ink fountain because the ink feed operation of the ink ductor roller stops. Since the upstream roller subgroup is disconnected from the downstream roller subgroup, the ink cannot be removed by blank sheet printing. In the present invention, therefore, the ink in the upstream roller subgroup is removed not by "ink return to fountain" or blank sheet printing, but by, e.g., using the ink cleaning device or scraping the ink by the blade.

For example, when the present invention adopts the arrangement capable of dividing the ink roller group into two roller subgroups, ink in the upstream roller subgroup is removed, and then the ink-removed upstream roller subgroup and the downstream roller subgroup are coupled and return to the single ink roller group. In this case, the ink form rollers are thrown off, so ink after the end of a preceding print job remains in the downstream roller subgroup. In this state, the single ink roller group is driven to rotate by an arbitrary number of revolutions. Then, the ink remaining in the downstream roller subgroup is leveled between the downstream roller subgroup and the upstream roller subgroup, forming a thin, flat ink film thickness distribution (basic ink film thickness distribution) in the ink roller group.

In the arrangement capable of dividing the ink roller group into two roller subgroups, the ink roller group is divided again into upstream and downstream roller subgroups. The opening ratios of the respective ink fountain keys are set to values corresponding to an image on a printing plate to be used for printing of the next job. After that, an ink film thickness distribution in preliminary ink feed is formed in the redivided upstream roller subgroup. In this state, the basic ink film thickness distribution is formed in the downstream roller subgroup, and the ink film thickness distribution in preliminary ink feed is formed in the upstream roller subgroup.

In the arrangement capable of dividing the ink roller group into two roller subgroups, after forming the ink film thickness distribution in preliminary ink feed in the upstream roller subgroup, the upstream roller subgroup in which the ink film thickness distribution in preliminary ink feed is formed and the downstream roller subgroup in which the basic ink film thickness distribution is formed are coupled again and return to the single ink roller group. After the return to the single ink roller group, the ink form rollers are thrown on to start a print job (next print job) using the next printing plate.

In this case, the ink film thickness distribution (ink film thickness distribution in final printing) in printing using the next printing plate is created during printing, that is, while consuming ink from the end of the ink roller group. At this time, the ink film thickness distribution in the downstream roller subgroup becomes thinner than that during normal printing. Thus, ink flows from the upstream side to the downstream side faster than in normal printing. An ink film thickness distribution during final printing is formed quickly in the ink roller group.

What is claimed is:

1. An ink film thickness distribution forming method in an ink supply apparatus including an ink fountain storing an ink, a plurality of ink fountain keys arranged in the ink fountain, an ink fountain roller to which the ink is supplied from the ink fountain in accordance with opening ratios of the plurality of ink fountain keys, an ink ductor roller to which the ink is transferred from the ink fountain roller by an ink feed operation, and an ink roller group including at least one ink form roller to which the ink transferred to the ink ductor roller is supplied, comprising the steps of:

performing a throw-off operation of the ink form roller positioned at an end of the ink roller group after an end of a print job using a preceding printing plate;

stopping the ink feed operation of the ink ductor roller after the end of the print job using the preceding printing plate;

dividing the ink roller group into a plurality of roller subgroups after the end of the print job using the preceding printing plate; and removing the ink in at least one of roller subgroups out of the divided roller subgroups.

2. A method according to claim 1, further comprising the steps of:

after removing the ink in at least one of roller subgroups, coupling the divided roller subgroups to return to the single ink roller group; and driving the coupled ink roller group to rotate by a predetermined number of times.

3. A method according to claim 2, further comprising the steps of:

before the ink removal operation, setting the opening ratios of the plurality of ink fountain keys to values corresponding to an image on a printing plate to be used for printing of a next job;

after driving the ink roller group to rotate, dividing again the ink roller group into a plurality of roller subgroups; and after dividing again the ink roller group into the plurality of roller subgroups and setting the opening ratios of the plurality of ink fountain keys, forming an ink film thickness distribution in preliminary ink feed in an upstream roller subgroup out of the redivided roller subgroups by performing the ink feed operation of the ink ductor roller by a predetermined number of times.

4. A method according to claim 3, further comprising the steps of:

after forming an ink film thickness distribution in preliminary ink feed in the upstream roller subgroup, coupling again the redivided roller subgroups to return to the single ink roller group; and after coupling again the roller subgroups, starting a print job using a next printing plate by performing a throw-on operation of the ink form roller.

* * * * *